US009114056B2

(12) United States Patent
Imboden et al.

(10) Patent No.: US 9,114,056 B2
(45) Date of Patent: Aug. 25, 2015

(54) SYSTEMS, DEVICES AND METHODS FOR PERSONAL MASSAGE

(71) Applicant: JJ ACQUISITION, LLC, San Francisco, CA (US)

(72) Inventors: Ethan Frederic Imboden, San Francisco, CA (US); Jeff Wyatt, Bozeman, MT (US)

(73) Assignee: JJ Acquisition, LLC, San Francisco, CA (US)

( * ) Notice: Subject to any disclaimer, the term of this patent is extended or adjusted under 35 U.S.C. 154(b) by 386 days.

(21) Appl. No.: 13/662,098

(22) Filed: Oct. 26, 2012

(65) Prior Publication Data

US 2013/0109913 A1 May 2, 2013

Related U.S. Application Data

(60) Provisional application No. 61/551,837, filed on Oct. 26, 2011, provisional application No. 61/551,845, filed on Oct. 26, 2011, provisional application No. 61/709,121, filed on Oct. 2, 2012.

(51) Int. Cl.

| | |
|---|---|
| ***A61H 19/00*** | (2006.01) |
| ***A61H 1/00*** | (2006.01) |
| ***A61H 23/02*** | (2006.01) |

(52) U.S. Cl.

CPC ..... *A61H 19/00* (2013.01); *A61H 1/00* (2013.01); *A61H 19/30* (2013.01); *A61H 19/34* (2013.01); *A61H 23/0218* (2013.01); *A61H 23/0245* (2013.01); *A61H 23/0263* (2013.01); *A61H 2201/0111* (2013.01); *A61H 2201/0188* (2013.01); *A61H 2201/164* (2013.01); *A61H 2201/165* (2013.01); *A61H 2201/1683* (2013.01); *A61H 2201/501* (2013.01); *A61H 2201/5097* (2013.01)

(58) Field of Classification Search

CPC ..... A61H 19/34; A61H 19/44; A61H 19/00; A61H 19/32; A61H 23/0263; A61H 2201/5097; A61H 2201/5035; A61H 2201/5048; A61H 2201/5015; A61H 2201/0153; A63F 13/06

See application file for complete search history.

(56) References Cited

U.S. PATENT DOCUMENTS

| | | | | |
|---|---|---|---|---|
| 3,996,930 | A | 12/1976 | Sekulich | 128/67 |
| 5,853,362 | A | 12/1998 | Jacobs | 600/38 |

(Continued)

FOREIGN PATENT DOCUMENTS

| | | |
|---|---|---|
| CA | 2 471 525 | 3/2005 |
| EP | 1 477 149 A1 | 11/2004 |
| GB | 2 401 551 B | 11/2004 |

*Primary Examiner* — Samuel Gilbert

(74) *Attorney, Agent, or Firm* — Manuel de la Cerra

(57) ABSTRACT

The present invention relates to a modular erogenous stimulation system including at least one vibratory device for stimulating the erogenous zones and at least one control module that for controlling the operation of the vibratory device; and to an embodiment of the at least one vibratory apparatus that may be worn by a female for stimulating the internal vaginal erogenous zones, the external clitoral erogenous zones, or both the internal and external clitoral erogenous zones of the female genitalia simultaneously, while allowing sufficient clearance of the vaginal canal to also permit insertion of a penis or other similarly configured and dimensioned implement, such as a dildo or vibrator, when the apparatus is being properly worn by the female to create an interaction between the partners that is pleasurable for all involved.

20 Claims, 34 Drawing Sheets

(56) References Cited

U.S. PATENT DOCUMENTS

| | | | | |
|---|---|---|---|---|
| 6,132,366 | A | 10/2000 | Ritchie et al. | 600/38 |
| RE38,924 | E | 12/2005 | Ritchie et al. | 600/38 |
| 7,081,087 | B2 | 7/2006 | Jannuzzi | 600/38 |
| 7,452,326 | B2 * | 11/2008 | Fladl et al. | 600/38 |
| 7,510,537 | B2 | 3/2009 | Imboden et al. | 601/70 |
| 7,530,944 | B1 | 5/2009 | Kain | 600/38 |
| D605,779 | S | 12/2009 | Murison | D24/215 |
| 7,717,867 | B2 * | 5/2010 | Nan | 601/46 |
| 7,828,717 | B2 | 11/2010 | Lee | 600/38 |
| 7,931,605 | B2 * | 4/2011 | Murison | 601/70 |
| 2003/0195441 | A1 | 10/2003 | Firouzgar | 601/46 |
| 2004/0230093 | A1 | 11/2004 | Marshall | 600/38 |
| 2005/0203335 | A1 | 9/2005 | Stachon | 600/39 |
| 2006/0141903 | A1 | 6/2006 | Gardos et al. | 446/490 |
| 2008/0009775 | A1 | 1/2008 | Murison | 601/46 |
| 2008/0027275 | A1 | 1/2008 | Topolev | 600/38 |
| 2010/0087703 | A1 * | 4/2010 | Gabrielidis | 600/38 |
| 2012/0179077 | A1 * | 7/2012 | Tuck et al. | 601/46 |

* cited by examiner

SYSTEMS, DEVICES AND METHODS FOR PERSONAL MASSAGE

FIELD OF THE INVENTION

The principles of the present invention relate to a modular system for the sexual stimulation of erogenous zones involving a massager system having a modular structure including a variety of vibratory apparatuses having interchangeable control modules.

BACKGROUND OF THE INVENTION

Many sexual stimulation devices are presently available for use by both men or women with or without a partner. These devices can be strictly manual or may include a vibrating mechanism, and may be used either internally to stimulate the vagina and G-spot, or externally to stimulate the clitoris, and may also provide penial or anal stimulation depending upon their design and dimensions. Some such devices have drawbacks, which embodiments of the massager illustratively described herein can overcome.

For example, the selection of erogenous stimulation devices presently available lack both upgradeability and interoperability that would allow a purchaser to enter the market for such stimulators at a reasonable price and then upgrade the functionality and expand their collection of devices over time without sacrificing the initial investment, due to the ability to interchange the modular components and capitalize on their cross-functionality.

BRIEF SUMMARY OF THE INVENTION

The principles of the present invention relate to a modular erogenous stimulation system comprising at least one interchangeable control module configured and dimensioned to be releasably engaged and operationally associated with any one of a plurality of vibratory devices, wherein the control module comprises at least a power source and controls that may be an electronic control board and electrical components wired together, electronic controls mounted directly to a body surface, or an on-off switch, and at least one vibratory device having a first body structure comprising a docking portion configured and dimensioned to releasably engage the control module, wherein the docking portion and control module become operatively associated when engaged, a spine extending from the docking portion, and at least one vibratory mechanism affixed to the spine and in electrical communication with the control module when the control module is engaged with the docking portion. The control module may further comprise a user interface and the docking portion and spine may comprise a resilient substructure and over-mold. The control module is easily removable from the docking portion of the vibratory device, so a user can disengage the control module without difficulty by hand. A releasably engaged control module can be disengaged from a docking portion of a device so that it disassociates from the electrical contacts.

The present invention also relates to a modular system that further comprises a second vibratory device having a second body structure different from the first body structure, wherein the docking portion of the second body structure is also configured and dimensioned to releasably engage the control module, and wherein the docking portion and control module become operatively associated when engaged; and may further comprise a second control module configured and dimensioned to be releasably engaged and operationally associated with any one of a plurality of vibratory devices, wherein the second control module has different features from the first control module, and the first and second control module can be swapped between the first and second vibratory devices without difficulty.

Other embodiments of a vibratory device are also contemplated. For example, the docking portion of the vibratory device can be a control module housing which is configured and dimensioned for the control module to be slidably inserted into the control module housing; and the spine comprises at least a first elongated member having a 'U' shape with a proximal end connected to the control module housing and a distal end curved below the proximal end, and a vibratory mechanism affixed to the distal end, wherein the first elongated member is configured and dimension for insertion into a vagina, so as to provide an unobstructed entry and sufficient remaining space for insertion of a penis shaped object into the vagina; and at least a second elongated member shorter than the first elongated member having a proximal end connected to the control module housing adjacent to the proximal end of the first elongated member. The position of the first elongated member also fits comfortably between the vulva and against the vaginal wall; and at least the second member can be positioned to apply a downward pressure against the clitoris or a downward pressure against the labia and lateral pressure against the clitoris. The vibratory device with a U-shaped spine and a second elongated member can stimulate both the clitoris and G-spot simultaneously, wherein the distal end of the spine is configured and dimensioned for insertion into the vagina, and the second elongated member is configured and dimensioned for placement in contact with the clitoris.

The docking portion of the vibratory device can also be for example a control module housing which is configured and dimensioned for the control module to be slidably inserted into the control module housing; and the spine of the vibratory device comprises an elongated member with two arms extending from a branching point of a longer leg to form a 'Y' shape section, wherein the longer leg curves below the two arms, and an extension section connects the control module housing to the 'Y' shaped section. The vibratory device may further comprise at least one vibratory mechanism affixed to the distal end of the longer leg, and more preferably at least three vibratory mechanisms, where one vibratory mechanism is affixed to the distal end of each of the elongated members, such that the longer leg of the 'Y' section can be inserted into a vagina, and the two shorter branching arms can be positioned to apply a downward pressure against the labia and lateral or downward pressure against the clitoris to stimulate the clitoris and G-spot simultaneously. A control module is operationally associated with the vibratory device and in electrical communication with each of the vibratory mechanisms when engaged with the docking portion of the vibratory device.

In another embodiment for example, the spine comprising the elongated members can be directly attached to the control module without an intervening docking portion, with a mechanical connector, or hard-wired together, or with the docking portion.

In some embodiments of the Y-shaped device, the extension section may be a long, flexible connection, and in a particular embodiment can be a wire, wherein the wire may be irremovably connected to the vibratory device for example by a soldered connection, and in other embodiments the elongated section or wire may be easily removable such as by being connected with a male plug and female socket combination as known in the art, or may be removable by using a connector that is fastened to the vibratory device with a fastening component that requires a tool for disconnection to avoid unintended disconnections.

The present invention also relates to a vibratory apparatus comprising a vibratory device having a body structure comprising a docking portion, wherein the docking portion is configured and dimensioned to receive a control module; and a spine, wherein the spine comprises one or more elongated members extending from the docking portion, wherein each of the one or more elongated members has a distal end to which a vibratory mechanism is affixed; and a control module operatively associated with the vibratory device. The vibratory device can comprise a docking portion comprising a substructure, and one or more electrical contacts associated with the substructure [or forming an electrical connection between the control module and the one or more vibratory mechanisms, wherein the electrical contacts are arranged in a predetermined pattern; and the spine comprises at least one surface through which a massaging operation of one or more vibratory mechanisms is applied to a person.

In another embodiment for example, the docking portion can be a control module housing or a docking plate; and the spine comprises; a first elongated member having a 'U' shape with a proximal end connected to the control module housing and a distal end curved below the proximal end, wherein a vibratory mechanism is affixed to the distal end; and a second and third elongated member shorter than the first elongated member each having a proximal end connected to the proximal end of the first elongated member at the connection to the control module housing, and a distal end angled downward from the proximal end, wherein a vibratory mechanism is affixed to each of the distal ends. The elongated members can be made of a resilient, elastically deformable material, wherein the material may be a nylon The vibratory apparatus can also have the first elongated member configured and dimensioned for insertion into the vagina, so as to provide an unobstructed entry and sufficient remaining space for insertion of a penis shaped object into the vagina, and fits comfortably between the vulva and against the vaginal wall; and the second and third elongated members are configured and dimensioned to position a vibratory mechanism located at the distal end of each of the second and third elongated members against either side of the clitoris and against the labia.

The control component may comprise a control module, one or more remote control(s), one or more sensors, wherein the sensor(s) may be integral with a remote control or independent, and/or one or more wireless transmitter/receiver components.

The control module can comprise a user interface for selecting an operating mode from a plurality of options; electronic circuitry suitable for independently controlling the operation of a plurality of vibratory mechanisms. The control module can further comprise a printed circuit board, wherein the electronic circuitry is mounted on the printed circuit board (PCB) suitable for independently controlling the operation of a plurality of vibratory mechanisms, and a radio receiver for receiving radio frequency control signals transmitted by a remote control, wherein the control circuits are suitable for processing the received radio control signals. The control circuitry can comprise a simple on-off switch, analog and/or digital electronic components for controlling the current and voltage delivered to vibratory mechanisms, and/or a non-transitory computer readable medium for storing instructions that provide various separate operating modes or patterns for the individual vibratory mechanisms readable by a computer processor, and a computer processor, wherein the separate operating modes provide for operating each of the separate vibratory mechanisms at one or more different individual vibratory frequencies to produce a harmonic pulsating effect, and/or varying the vibratory frequency, pattern, and intensity of each vibratory mechanism over time during operation to produce a pulsed effect; a processor for reading the non-transitory computer readable medium and providing electrical signals and power to the plurality of vibratory mechanisms, and a power source, and electrical contacts mounted on the printed circuit board for communicating the electrical signals and power to the plurality of vibratory mechanisms.

The principles of the present invention also relate to a modular stimulation system kit comprising; one or more control module(s); and one or more vibratory device(s) that can be operatively associated with the one or more control module(s), wherein the control module(s) and vibratory device(s) are adapted to have a combination of contact points that are configured to be connected by a user who purchases the kit. The one or more control modules are easily removable from the one or more vibratory devices. A kit may also comprise one or more control module(s), wherein at least one of the one or more control module(s) comprises a rechargeable battery; and the kit can further comprise a battery recharging base for recharging the rechargeable battery. The recharger base can form an electrical path to a rechargeable battery, or the recharger can inductively charge a rechargeable battery without forming a direct electrical path.

The principles of the present invention further relate to a method of stimulating erogenous zones. For example, by providing a modular stimulation system, adjusting the positioning of each of the elongated members such that a pleasurable amount of pressure is applied to the clitoris and an anterior side of a vaginal wall when the first elongated member is inserted into a vagina; inserting the apparatus into the vagina; and selecting an operating mode using the user interface of the operatively associated control module, and can further comprise performing intercourse, wherein a male partner's penis or another penis-like object is inserted into the vagina in addition to the first elongated member of the vibratory apparatus so that both the male and female member experience stimulation.

The principles of the present invention further relate to a vibrating massager comprising a first body comprising a vibrator and a surface in relationship with the vibrator and adapted to apply the vibrations of the motor to massage a human surface, a mechanical connector, and a conductor that traverses at least a portion of a distance between the vibrator and the mechanical connector, wherein the mechanical connector comprises an electrical contact that is in conductive communication with the motor; and a second body comprising circuitry that includes a second conductor that carries a source of power and a source of a control signal and traverses a portion of the second body, a mechanical connector configured to be in conductive communication with the second conductor, wherein the mechanical connector comprises a second electrical contact through which the second body applies a control signal and power signal to the motor when the second body is mechanically connected to the first body.

The principles of the present invention further relate to an apparatus comprising a vibrator that is configured to massage the human body; a body in physical contact with the vibrator and having a structural support that is configured to physically support the mechanical attachment of a control module to the body, wherein the mechanical attachment is adapted to be releasably attached and be detachable by a user without breaking, tearing, or dissolving.

The principles of the present invention further relate to a simulation apparatus comprising one or more control modules; and one or more vibratory devices that can be operatively associated with the one or more control modules, wherein the control module(s) and vibratory device are adapted to have a combination of contact points that are configured to be connected by a user.

The principles of the present invention further relate to a non-transitory computer readable storage medium having computer-readable instructions executable by a computer processing system stored thereon, the computer-readable instructions comprising; instructions that cause control electronics to produce a driving current having a particular wave form and frequency for communication to separate vibratory mechanisms; instructions that cause control electronics to increase or decrease the current communicated to each of the separate vibratory mechanisms; and instructions to determine if the computer processing system is operatively associated with a vibratory device.

The present invention also relates to a vibratory device comprising a docking portion configured and dimensioned to releasably engage a control module, wherein the vibratory device is easily removable from a mating control module with which the vibratory device is engaged; a printed circuit board affixed to a face of the docking portion; a plurality of electrical contacts mounted on the printed circuit board, wherein the electrical contacts are arranged in a predetermined pattern that corresponds to an arrangement of electrical contacts on a mating face of the control module; a spine extending from the docking portion; and at least one vibratory mechanism affixed to the spine and in electrical communication with the electrical contacts mounted on the printed circuit board. The docking portion may be a control module housing, and the spine may comprise at least a first elongated member having a 'U' shape with a proximal end connected to the control module housing and a distal end curved below the proximal end, and a vibratory mechanism affixed to the distal end; and at least a second elongated member shorter than the first elongated member having a proximal end connected to the proximal end of the first elongated member and adjacent to the control module housing.

The spine of the vibratory device may comprise an elongated member with two arms extending from a branching point of a longer leg to form a 'Y' shape section, wherein the longer leg curves below die two arms; and an extension section having two ends, wherein a first end is connected to the docking portion and the second end is connected to the longer leg of the 'Y' shaped section, and the extension section extends away from the longer leg in the plane of the curve.

The control module may comprise a control module body, wherein the control module body is configured and dimensioned to releasably engage a docking portion of a vibratory device; a printed circuit board affixed to a face of the control module body; control electronics, wherein the control electronics are mounted on an interior face of the printed circuit board; electrical contacts, wherein the electrical contacts are mounted on the exterior face of the printed circuit board and arranged in a predetermined pattern that corresponds to an arrangement of electrical contacts on a mating face of a vibratory device, wherein the control module is easily removable from a docking portion of a mating vibratory device with which the control module is engaged. Removing the control module from the docking portion of the vibratory device disengages the control module from any housing, fasteners, or retaining features and disassociates the electrical contacts of the control module from the corresponding contacts of the docking portion. In other embodiments, the control module can also be removable from the elongated members that can be affixed to the control module.

In other embodiments, the control module is irremovable from the elongated members. In other embodiments, a pliable over-mold covers at least a portion of both the elongated members and the control module, where the over-mold is preferably a bio-compatible, silicone rubber, thermoplastic elastomer (TPE), or thermoplastic rubber (TPR). In other embodiments, the over-mold covering the distal end of the elongated vaginal member comprises a convex surface facing the clitoral members and control module, and a concave surface facing away from the clitoral members and control module to form a tortoise-shell like shape that allows insertion of a penis or other similarly shaped sexual device or object into the vagina.

In other embodiments, a vibratory apparatus comprises a control module configured to be operationally associated with a vibratory device; and a vibratory device having a body structure comprising; a spine extending from the control module; and at least one vibratory mechanism affixed to the spine and in electrical communication with the control module, wherein the spine connects and supports the control module and the vibratory mechanism such as a skeleton. In embodiments of the vibratory apparatus, the spine is not within a cavity.

In other embodiments, a personal massage apparatus comprises a substructure of a elastically deformable resilient material comprising; a body; and a triangular arrangement of three elongated members extending from a center location of one face of the body, wherein the member forming the central leg is an elongated member having a U-shape that curves back towards the body, and the members forming the left and right legs of the arrangement are angled downward in a plane that forms an acute angle with the plane of the proximal portion of the central leg, and the left and right legs are straight and shorter than the central leg.

In other embodiments, the personal massage apparatus further comprises an over-covering of a soft, pliable rubber material on some or all of the surfaces, and can further comprise a vibratory mechanism located within the substructure at a distal end of each of the extending members.

In other embodiments, the elongated members have channels formed therein, and the vibratory mechanisms affixed to the distal ends of the elongated members are electrically connected to the control module by wires that run along the channels, wherein the wires and channels are covered by the over-mold. In other embodiments, the vibrator further comprises a junction box in the flared portion of the proximal end of the vaginal member, wherein the wires from the vibratory mechanisms are connected to the wires from the control module at the junction box.

In other embodiments, the control module communicates power and control signals separately to the individual vibratory mechanisms along the wires. The vibrator can further comprise a remote control that communicates control signals to the control module through electromagnetic waves to control operation of the vibratory devices.

In other embodiments, the control module comprises a user interface, a power source and control electronics.

The vibrator device can also comprise two elongated clitoral members attached to the flared portion of the proximal end of the elongated vaginal member and extending away from the control module and vaginal member forming an angle θ between the clitoral members and the vaginal member.

Combinations of the above claims and combinations of the elements of the above claims are also contemplated, including broader claims to generic embodiments.

Other features and functionality are described in U.S. Pat. No. 7,815,582, issued Oct. 19, 2010, to Imboden et al., which is expressly incorporate herein in its entirety by reference for all purposes. Additional features and functions are described in U.S. Pat. No. 7,749,178, issued Jul. 6, 2010, to Imboden et al., U.S. Pat. No. 7,938,789, issued May 10, 2011, to Imboden et. al., and U.S. patent application Ser. No. 11/971,835, filed Jan. 9, 2008 for Imboden et al., which are all expressly incorporated herein in their entirety by reference for all purposes. This application also expressly incorporates herein by reference in their entirety U.S. Provisional Application Nos. 61/551,837, filed Oct. 26, 2011, 61/551,845 filed Oct. 26, 2011, and 61/709,121 filed Oct. 2, 2012, for all purposes.

BRIEF DESCRIPTION OF THE DRAWINGS

Further features of the present invention, its nature and various advantages will become more apparent upon consideration of the following detailed description, taken in conjunction with the accompanying drawings, which are also illustrative of the best mode contemplated by the applicants, and in which like reference characters refer to like parts throughout, where.

DETAILED DESCRIPTION OF THE INVENTION

The principles of the present invention relate to a modular erogenous stimulation system including at least one vibrator component, which can be a vibratory device for stimulating the erogenous zones, and at least one control component, which can be a control module that can be docked with and removed easily from the vibratory component.

The present invention also relates to various embodiments of at least one vibratory apparatus that may be worn by a female for stimulating the internal vaginal erogenous zones, external clitoral erogenous zones, or both the internal vaginal erogenous zones and external clitoral erogenous zones of the female genitalia simultaneously, or worn by a male for stimulating the female erogenous zones, the male erogenous zones, or both simultaneously.

The various embodiments of the present invention relate to a vibratory apparatus comprising a control module and a vibratory device, wherein the vibratory device comprises a body structure having a docking portion for mating with the control module and a solid spine extending from the docking portion. The body structure may further comprise an attachment portion for attaching the vibratory device onto an anatomical part of a user.

In another embodiment, the vibratory device comprises an attachment portion and a docking portion, wherein the docking portion is associated with the attachment portion, and at least one vibratory mechanism electrically connected to the control module. The vibratory mechanism(s) can be connected to the control module by wires or a flex circuit.

Figure 26:
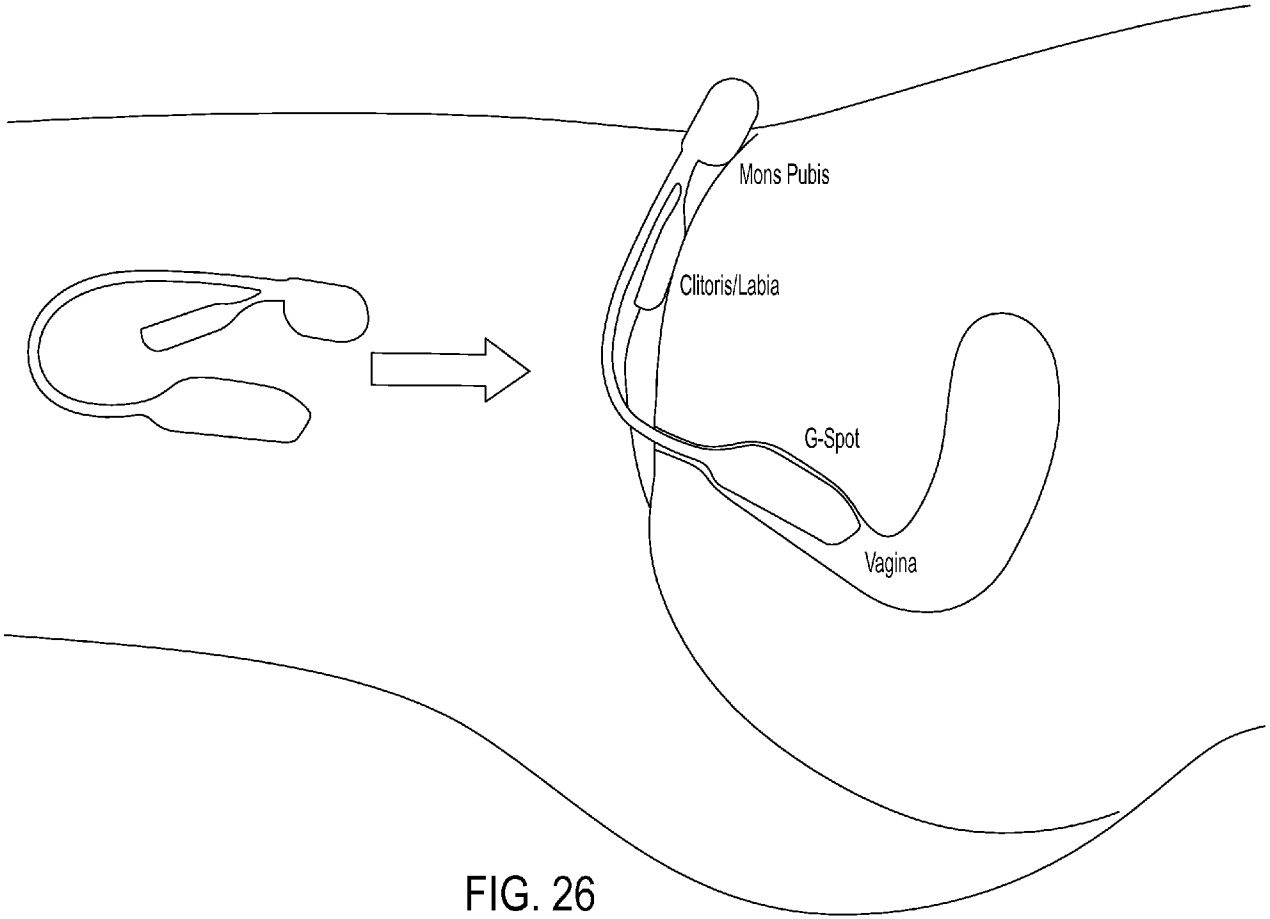
FIG. 26 is an illustration depicting the proper way to insert and wear an example of the more preferred embodiment of the present invention.

In a preferred embodiment of a vibratory apparatus worn by a female, the apparatus can stimulate at least the internal vaginal erogenous zones, while allowing sufficient clearance of the vaginal canal to also permit insertion of a penis or other similarly configured and dimensioned implement, such as a dildo or vibrator, when the apparatus is being properly worn by the female, (see FIG. 26.) By providing sufficient room for insertion of a penis or other implement, a mutually pleasurable sexual interaction can be created for both partners during sex-play or intercourse. The surfaces, vibrations, and massaging operation of the vibratory device are preferably adapted for use in sexual stimulation or sexual aid.

In the various embodiments of the present invention, the vibratory device can comprise a docking portion and a spine, wherein the spine preferably comprises at least an elongated member that is configured and dimensioned for insertion into a female vagina and contact with the G-spot, and may further comprise one or more additional elongated members configured and dimensioned to contact the female clitoris, when properly worn. Each of the elongated members can end in a vibratory mechanism affixed to the elongated member and electrically connected to contacts that can be electrically associated with a power source, such that the vibratory mechanisms deliver vibrational stimulation to at least the G-spot, and preferably the clitoris and G-spot.

In a preferred embodiment, the vibratory device has three elongated members each having a proximal end joined with the control module housing and a distal end that is intended to be in contact with an erogenous zone of the wearer. The distal end of each elongated member is configured and dimensioned to hold a vibratory mechanism, while fitting the body comfortably and in a manner that provides optimal stimulation. The proximal ends of each of the plurality of elongated members are preferably adjacent to each other at the point of connection between the members and the control module housing, however not all of the connection points of the plurality of members necessarily lie in the same plane.

In another embodiment, the vibratory device has a docking portion and a spine comprising only a single elongated member configured and dimensioned for insertion into a female vagina having at least one surface through which a massaging operation from a vibratory mechanisms is applied at least to the person wearing the device. The massaging operation of the device is preferably adapted for sexual stimulation or as a sexual aid. The single elongated vaginal member would be a 'U' shaped elongated member curving below the docking portion.

In another embodiment, the vibratory device has a docking portion and a spine comprising two elongated members, each having a vibratory mechanism affixed at a distal end, wherein one elongated member is configured and dimensioned for insertion into a female vagina, and the other elongated member is configured and dimensioned for positioning against the clitoris for stimulating both the internal vaginal erogenous zones and external clitoral erogenous zones of the female genitalia simultaneously.

In yet another embodiment, the vibratory device has a docking portion and a spine comprising two elongated members wherein one elongated member is configured and dimensioned for insertion into a female vagina, and the other elongated member is configured and dimensioned for positioning against the clitoris and has a vibratory mechanism affixed at a distal end. This configuration would allow for stimulation of the external clitoral erogenous zones of the female genitalia without requiring the wearer to hold the vibratory device in place. The restoring force created by the resilient spine and determined by the spring constant of the particular material and dimensions causes the vibratory device to hold itself in position by preferably pressing against the G-spot and mons pubis, thereby providing hands-free operation when properly worn by a female, as shown in FIG. 26.

The modular stimulation system may further comprise a recharging station, also referred to as a charger, for charging a rechargeable battery within a control module, at least one additional vibratory apparatus that may have a different physical design from the first vibratory apparatus, and/or a remote user interface that can communicate with the control module or vibratory apparatus either by wire or wirelessly.

In the preferred embodiments of the present modular stimulation system, the system comprises at least one control module and at least one vibratory device that can be operatively associated with the control module to form a functioning vibratory apparatus.

The modular stimulation system may be provided as kits comprising at least one control module and at least one vibratory device, and may include a battery charger or additional peripheral devices to augment the available stimulation modes and options, and increase the convenience and pleasure of the parties. Control modules having different levels of functionality can be provided in different kits to differentiate between different levels of the stimulation system.

"Modular" is defined to be a number of separate, physically distinct components that operatively stand alone, such that each component can completely fulfill one or more separate discrete functions; and each component is removable or easily removable from any of the other associated components, as defined below. For example, a desktop computer with peripherals is a modular system, since a monitor, printer, keyboard, or mouse, can be disconnected from the computer and still retain all its intrinsic functionality, so that it will operate if and when it is connected with another computer. Similarly, the computer itself is modular, since video cards, communication cards, RAM memory chips, and even CPUs can be removed from a motherboard and still retain its functionality, whereas the motherboard and expansion cards themselves are not modular because the removal of a hard-wired IC, transistor, or other electronic component from the PCB would render some if not all functionality of the motherboard or card inoperable, even if all other components were present and properly connected. A typical printer cartridge is a modular component because it can be easily installed and removed from its associated printer and used in another printer of the same model.

The various embodiments of the vibratory device of the presently described invention are physically distinct components that function to make contact with the genitals and produce vibrations when powered, whereas the control module is a physically distinct component that provides power and/or control signals, and/or a user interface to allow changes in settings to an operatively associated vibratory device, and a charger provides the current, voltage, and electrical connections to recharge a rechargeable battery pack. Each control module and vibratory device is therefore a modular component having a discrete function that produces a working modular system when operatively associated with the other discrete component(s). In comparison, an elongated clitoral member affixed to an elongated vaginal member by adhesive or vibrational welding (as described below) would not represent two modular components because they are not removable or easily removable from each other. A vibratory mechanism could be either modular, as in the case of a bullet-type compact vibrator that operatively stands alone and is functionally independent from the device into which it is inserted, as compared to a vibratory mechanism that is affixed to an elongated member and hard-wired to electrical connections by soldering or other semi-permanent joining methods know in the art.

"Easily removable" means being able to physically/mechanically uncouple or disassociate one component from another by physically manipulating one or both components by hand. The uncoupling can be accomplished without the need of tools and without necessitating the breaking of any fastenings, joints, or semi-permanent connections (e.g.: a cap held in place by friction or pliable tabs is easily removable from the adjoining component; batteries are easily removable from a case where the battery door is held in place by a thumb-tab). For example, a plug would be easily removed from a mating earphone jack, since it could be disconnected by hand without the use of any tools. A RAM memory chip is easily removable from a typical motherboard socket because the latches can be manipulated by hand to release the RAM chip, and the chip can then be pulled the rest of the way out of the socket by hand. A childproof cap is easily removable from its associated container because even though it must be properly manipulated to allow uncoupling, the components can be pushed, squeezed, aligned, or unsnapped by hand without requiring a tool. In comparison, a paint can lid would not be easily removable because it requires a screwdriver or other tool to pry the lid from the can, although it would be removable since no fastenings or joints have to be broken to remove the lid from the can. A typical screw-in light bulb is easily removable from its socket, and a printer cartridge is easily removable from its associated printer, as well as a modular component as discussed above. An easily removable component would also be an easily installable component that did not require tools to be associated with a mating component.

In comparison, removable is defined as being able to physically/mechanically uncouple or disassociate one component from another requiring the reversible disconnection of one or more connectors or fasteners through the use of a tool without necessitating the breaking of any fastenings, joints, or semi-permanent connections (e.g.: rivets, permanently glued or welded joints, soldered wire or printed circuit board connections, etc.). For example, an expansion card in a computer is typically secured in place with a Phillips head screw. Since the card cannot be removed from the computer without using a screwdriver or breaking the board or fastener, an expansion board therefore is removable, but not easily removable. Another example of removable component are batteries that are removable from a water-tight case secured with one or more screws requiring a screwdriver to undo the screws.

If two components that can be physically mechanically disassociated from each other either by hand or through the use of a tool, the components are considered to be easily removable. For example, two components that can be uncoupled by manually maneuvering a tab to allow release, or could be pried apart using a screw driver, would be considered to be easily removable, since it could be accomplished by hand in a manner that did not require the use of any tools. An example of this is the child-proof cap discussed above that could be uncoupled by manipulating the mating parts to overcome the childproof feature, or just prying the cap off with a screwdriver or scissors.

Conversely, components that are easily removable or removable can also be reconnected or replaced through the reverse operation of the mating mechanical or magnetic connecter (e.g., standardized electromechanical connecters).

Something is irremovable or not modular if it requires breaking a semi-permanent connection or irreversibly disconnecting or uncoupling two or more parts. For example, a soldered, welded, or glued connection between two parts makes them irremovable in relation to each other because the solder, welded or glued joint, or permanent fastener must be broken to disassociate the parts. Further examples of this are electrical components connected by soldered junctions, or wires that are soldered to such connections, and plastic components epoxied or welded together that are therefore not modular in relation to each other. For example, the electronic components welded or glued to a PCB are not modular because removing a component would require breaking a semi-permanent connection, instead of undoing a reversible fastening.

An irremovable component can not be reconnected or replaced through a reverse operation. An irremovable component also cannot be reconnected or replaced through the interaction with a mating mechanical or magnetic connecter (e.g., standardized electromechanical connecters).

The term vibratory device is intended to mean the modular component having a body structure, one or more affixed vibratory mechanism(s) that would operate to produce a vibratory sensation through the device to a user if power was supplied to the vibratory mechanism(s), and preferably also an over-mold covering at least a portion of the body structure, whereas a vibratory apparatus is intended to mean a fully operational arrangement of modular components that can provide stimulation to a user, which in the particular embodiments would include a control module that is operationally associated with a vibratory device, such that the control module delivers power to the vibratory mechanism(s).

The various embodiments of the present invention may comprise a control module, wherein different control module designs have various design features and functionality to differentiate between product levels, and a vibratory device, wherein different vibratory device designs have various design features, body structures, and/or functionality to differentiate between product levels.

The purpose of a controller for a vibratory apparatus is to activate, change, or adjust the operational behavior of the one or more vibratory mechanism(s) of a vibratory device. A control module can comprise one or more interconnected or communicating control modules that can affect the functioning of a vibratory device by adjusting the power delivered to the vibratory mechanism(s) of the vibratory device, or changing the electrical aspects of such power being delivered to one or more vibratory mechanism(s). A control module functioning as a remote control and comprising at least a user interface and communication electronics, plus any additional power source, can be separate from a control module associated with a vibratory device and comprising the power source and control electronics for delivering power to the vibratory mechanisms. The one or more control modules not directly associated with the vibratory device can communicate control signals to the separate control module associated with the vibratory device and having the control electronics that are adjusting the power delivered to the vibratory mechanisms of the vibratory device. The control electronics may be either incorporated within the same control module that is generating the control signals, or control signals can be generated by a separate control module and communicated to the control module that is providing the power to drive the vibratory mechanisms. The control signals from the remote control can override the control signals set on the control module, or the input from the user interface of the control module can override the remote control signals, such that the most recently received control signals determine the operation of the vibratory device. The vibratory mechanism(s) could be driven by a power source in the same control module from which the control signals originate, or the power source could be in a control module or a stand-alone battery pack that is separate from the control module communicating the control signals to the control electronics. In another embodiment, the power source could be physically separate from the control electronics, but electrically connected to the control electronics and vibratory mechanism(s) over electrical paths.

A particular example of this embodiment is a power source that is in a separate power module or control module electrically connected to a control module and the control electronics housed therein by a wire, and the control electronics adjust the delivery of power from the separate power source to the vibratory mechanisms of a vibratory device. The user interface that accepts user commands could be incorporated in the control module with the control electronics, or the user interface could be in another physically separate control module electrically connected to the control module and the control electronics associated with a vibratory device by another wire, so control signals could be generated by one control module and communicated to the control electronics in another control module that triggers the control electronics, such as a solenoid, to deliver power to the vibratory mechanisms from a physically separate power source. The physically separate control module could also communicate commands and control signals to the control module associated with the vibratory device over a wireless connection if each of the separate control modules have suitable wireless communications electronics.

In this manner, multiple control modules can act as a single controller, where each control module performs a particular function including but not limited to accepting user commands at a user interface, generating control signals based upon the user commands or other external inputs from sensors, communicating the generated control signals to control electronics, triggering the control electronics to turn on or adjust the power delivered to the vibratory mechanism(s) affixed to a vibratory device, and producing vibrations that stimulate a wearer's erogenous zones.

A control module can comprise at least a control module body, a power source, and control electronics, wherein the power source and electronics are housed within the body and electrically connected by electrical paths. The control module can further comprise a printed circuit board (PCB), wherein the control electronics may be mounted to the control module housing or to the printed circuit board (PCB).

The power source provided within the control module may be one or more standard-sized batteries, wherein the preferred battery size is 'AAAA,' but the control module may also be designed to use '9V,' 'AAA', 'AA', or other sized batteries depending upon the expected operating time and power demands of the vibratory device. In other embodiments, the power source may be a rechargeable battery pack, where such rechargeable battery pack may be inductively rechargeable or reversibly, physically connected to a recharging device. The rechargeable batteries or battery pack can be any known in the art such as Lithium ion, nickel-metal-hydride, or nickel-cadmium. The control module is configured and dimensioned to contain the selected batteries of appropriate size and shape to power the vibratory device. In a preferred embodiment, the power source comprises two 'AAAA' batteries placed within the control module, and electrically connected with a user interface and control electronics.

In an embodiment of a control module, the control module can be configured and dimensioned to be the size and shape of a standard battery, wherein the control electronics and any power source would be fitted within the battery sized and shaped casing. Electronics for wireless communication with a separate user interface can also be included in the battery shaped control module for communicating commands to the control electronics. The control electronics are suitable for adjusting the power delivered to the device from the other remaining batteries. When implemented in this capacity, the battery sized and shaped control module is inserted in the device in place of a standard battery, and the normal controls on the device should be set to "on" and any adjustable settings also have their range set to their highest value, so that any subsequent adjustment by the battery-style control module could offer the full power range of the device. The functionality of a battery-style embodiment of the control module could include adjusting the power delivered by the other batteries, pulsing the power on and off, or ramping the power up and down. This embodiment of the control module would provide a remote control feature to a non-remote controlled type of device, such as an older or lower-priced model vibrator, or simply one that isn't otherwise available in a rechargeable or remote-controllable format.

The control electronics may range from an on-off switch, which would also be a user interface, that opens and closes a power circuit to one or more vibratory mechanisms of a vibratory device to processor-controlled digital electronics having non-transitory computer readable medium for holding program instructions and electronics suitable for controlling the vibratory frequency and intensity of the vibratory mechanism(s) either individually or in combination. The program instructions may be preprogrammed or upgradeable by downloading software from a website or other source; and the non-transitory computer readable medium may be erasable and reprogrammable. An intermediate product level can comprise a preprogrammed application specific integrated circuit chip (ASIC) and suitable electronic components for controlling the vibratory mechanism(s) having a predetermined set of operating modes and limited program instructions. It will be understood by the reader that the operation of controls are managed by a micro controller, and that many different variations of the control functions described may thus be programmed into the vibrating massager of the present invention and stored in the non-transient computer readable medium for later implementation by a processor.

The control electronics are mounted on a printed circuit board that also has electrical contacts on one of the faces of the PCB. The power source is electrically connected to the control electronics on the PCB by electrical paths. The power source can be connected to electrical contacts or connectors on the PCB, where the control electronics and electrical contacts/connectors are electrically connected to each other by printed circuitry on the PCB or wires, as known in the art. The PCB is attached to the control module body, and the face of the PCB having the electrical contacts forms one of the exterior faces of the control module. The electrical contacts are arranged in a predetermined pattern that is designed to match a corresponding arrangement of electrical contacts on an interior face of a docking portion, such as a control module housing, of a mating vibratory device. The electrical contacts are a conductive material that is preferably metal, and more preferably gold, nickel, stainless steel or a similar material to avoid corrosion and be bio-compatible. The contacts can be flush with the PCB surface, such as deposited pads, flat on the surface, such as surface mounted contacts, or the contacts may be raised above the surface of the PCB, such as leaf springs, to make a physical connection to a corresponding contact on a mating PCB with a positive force, when associated with a docking portion of a vibratory device. A control module having a PCB with flush gold contacts, for example, can make a positive contact with the corresponding raised contacts on a PCB forming part, of a docking portion of the vibratory device, when the control module is docked, attached, inserted, slid, or pressed into position to releasably engage the mating docking portion. The type of contacts on the control module PCB and docking portion PCB could all be the same, or the type of contacts on each PCB could be reversed or changed from the example provided above. A control module becomes operationally associated with a docking portion when all of the contacts or a predetermined subset of the contacts on one PCB make a positive connection with corresponding contacts on the mating PCB. When a control module is docked with a docking portion of a vibratory device, both a mechanical connection and an electrical connection is made between the control module and vibratory device at their interface.

Removing the control module from the docking portion of the vibratory device disengages the control module from any housing, fasteners, or retaining features and disassociates the electrical contacts of the control module from the corresponding contacts of the docking portion. As a further example, a light bulb is reversibly engaged by screwing it into a mating socket to form a mechanical connection, and the electrical contacts of the bulb become operatively associated with the electrical contacts of the socket. The light bulb can be disengaged from the socket by the reverse operation of unscrewing the bulb, which disassociates it from the electrical contacts of the socket.

In a preferred embodiment, the control module comprises a power source, control electronics and a PCB, wherein the control electronics are mounted on the PCB and the power source is electrically connected to the control electronics.

In another embodiment, the control module comprises control electronics and a PCB, wherein the control electronics are mounted on the PCB and housed within a control module body; and a power source is housed in a separate body and electrically connected to the control electronics, such that a power supply larger than what would fit in a control module can be connected to the vibratory apparatus and controlled by the control electronics of the control module.

The PCB is preferably housed within the control module body such that one face of the PCB forms an exterior face of the control module body, and the control electronics and power source contacts/connectors are mounted on the interior face of the PCB and electrical contacts for making contact with mating electrical contacts associated with the docking portion of a vibratory device are on the exterior face of the PCB.

The control module body can also be configured and dimensioned to have a polarized shape that could only be inserted into a mating space defined by the configuration and dimensions of the docking portion. In an embodiment, the docking portion can be a control module housing having an interior space into which a control module could be slidably inserted. The docking portion could also be a docking plate comprising mating features that releasably engage a control module body.

In certain preferred embodiments, the control module can also comprise a user interface operatively associated with the power source and control electronics that allows a user to turn the device on and off and select from the various functions or vibratory modes provided by the control electronics and/or processor instructions and independently adjust the intensities of each of the vibratory modes and functions. A user interface can comprise one or more buttons, dials, sliders, capacitance switches, motion sensors, position sensors, or other forms of controls or sensors, but preferably comprises three separate buttons arranged in a line, where the buttons function to control turning the power to the vibratory mechanisms of a vibratory device on and off, increasing the intensity of the vibrations of the vibratory mechanism(s), and cycling through any programmed vibratory modes or patterns stored in the control electronics of the control module, where vibratory modes are a predetermined set of operational parameters comprising the vibrational frequency of each vibratory mechanism, the vibrational intensity of each vibrational mechanism, the waveform of the driving signal sent to each vibratory mechanism, and the timed pattern of turning power to each vibratory mechanism on and off as well as changing each vibrational frequency, intensity, and/or waveform over time. The waveforms may be for example, sine waves, square waves, triangular waves, or other waves known to those in the art. The buttons may also function to put the control module, and therefore the vibratory mechanism, into a "locked" mode to ensure that the vibrator is not accidentally turned on, for instance when it is packed for travel. Other quantities and arrangements of buttons and other controls and sensors are also contemplated and fall within the scope and principles of the present invention. Preferably, a separate on-off switch may not be utilized when the control module comprises a user interface.

A preferred embodiment of a control module has three output channels corresponding to Output A, Output B, and Output C, to provide independent control of up to three vibratory mechanisms. The same driving signal (comprising a voltage, current, frequency, waveform, and time pattern) may be sent to all three output channels, as could be the case when the user interface is a simple on-off switch, or a different driving signal could be sent to each output channel, as would be the case for a control module having additional driver functions.

In a preferred embodiment, pulse width modulation is used to drive the motors, and control the vibratory mechanisms to adjust the vibration intensity by changing the duty cycle, and thereby the power output of the motors.

An embodiment of a control module with a user interface having three buttons would have a first button to cycle upwardly in vibrational intensity levels, a second button to cycle downwardly in vibrational intensity levels, and a third button to cycle through the different vibrational modes and/or patterns stored as control instructions in the control electronics. The number of pre-programmed modes stored in the control module would depend on the size of the non-transient computer readable medium in the control module.

In a preferred embodiment, there are five intensity levels where level 0 is off, level 1 is the lowest vibrational mode, levels 2-4 are intermediate levels having equal changes in intensity between each level of 1-5, and level 5 is the highest vibrational intensity level. When changing from level 0 to level 1, there is a momentary, programmed power surge to ensure that enough startup torque is available to get the motor (s) spinning. A control module can be turned off and put into a "locked" mode to ensure that the vibrator is not accidentally turned on, for instance when it is packed for travel. Although the preferred embodiment has five intensity levels, a greater or fewer number of intensity levels to allow greater or lesser control of the vibratory device operation are contemplated within the scope of the present invention, and can be used to distinguish different product functionality levels. Although the preferred embodiment has equal changes in intensity between each of the intensity levels, non-linear changes in intensity are also contemplated within the scope of the invention.

In a preferred embodiment, a vibratory apparatus will pulse on and oil three times in quick succession when a control module having multiple intensity level settings is docked with a vibratory device to indicate that it is properly docked and operational. For safety, the control module can also turn off automatically when it is undecked from a vibratory device and ensure that while it is undocked, no voltage will be applied to the electrical contacts for making contact with mating electrical contacts associated with the docking portion of a vibratory device.

The control module may also further comprise one or more LEDs, electroluminescent panels, or other sources of illumination to light the controls, to allow the device to be discernable in the dark, and/or for other practical and aesthetic purposes. Preferably the illumination source lights momentarily when the control module is operatively associated with the vibratory device, and therefore can constitute an indicator lamp that signals the apparatus is ready to be used. The source of illumination may also light when the vibratory apparatus is on. In another embodiment, the LED or other illumination source may turn on and off in a pattern to indicate the amount of battery charge available for the vibratory apparatus, such as by blinking rapidly.

In an embodiment, the user interface is operatively associated with the power source and control electronics by being electrically connected to the power source and control electronics, whereas in another embodiment the user interface is operatively associated with the power source and control electronics through a wireless connection. In the embodiment in which the user interface is electrically connected to the power source and control electronics, the user interface may be integrated into the control module, itself, or the user interface may be separate from the control module but electrically connected to the control module over a suitable length of wire, wherein the wire may be approximately 3 feet long to allow a wearer to hold the user interface while wearing the vibratory device and associated control module, or long enough for another party to hold the user interface at a distance of 8 to 10 feet from the wearer. A plug and jack(s) or socket(s) can be used to both mechanically and electrically connect the wire between a remote control and the control module, and/or between a control module and a vibratory device. In an embodiment utilizing a wireless connection between the control module and user interface, both the control module and user interface further comprise a wireless transceiver (or the control module comprises a receiver and the user interface comprises a transmitter), antenna, and suitable electronics for communicating signals between the user interface and control module, as would be know to those of ordinary skill in the art.

When the user interface is physically incorporated in the control module, the buttons are preferably located on a face of the control module such that when the control module is inserted in a control module housing the buttons are positioned in a window opening of the control module housing substructure and only covered by the pliable over-mold material. The buttons may be depressed through the window and pliable over-mold by a user.

The control module body preferably has a cuboid shape having six faces, and is more preferably a rectangular prism that is configured and dimensioned to receive a control module. The edges and corners of the control module body are preferably rounded to improve comfort and safety by avoiding sharp corners that can poke, pinch, or scratch a wearer or partner during use of the apparatus. In a preferred embodiment, one of the faces of the control module body is rounded to form a convex shape extending along the long axis of the rectangular module body. Other shapes, such a hemispheres, triangular prisms, cylinders, etc, can also be used for the control module without deviating from the principles and scope of the present invention.

The control module has a portion that is adapted to be cooperatively associated with a mating vibratory device, and configured and dimensioned so as to dock with such a vibratory device in only one orientation. In preferred embodiments, the shape of a control module body is polarized so it can only be inserted into a control module housing in one way. The electrical contacts of the control module are spaced and arranged so that they form electrical connections with the electrical contacts of the mating vibratory device when the control module and vibratory device are operatively associated. The controlled orientation or polarization of the cooperatively associated components ensures the electrical contacts on the control module PCB properly align with the correct electrical contacts of the vibratory device for communicating power and control signals to the vibratory mechanism(s) of the vibratory device.

The control module is preferably configured and dimensioned so as to be standardized for use with any vibratory device having a correspondingly configured and dimensioned docking portion to allow any control module to be interchangeable with any other similarly configured control module and compatible with any corresponding vibratory device.

In other embodiments, the vibratory apparatus comprises at least a second control module, wherein the at least first and second control modules are interchangeable control modules that are easily removable from and can be swapped between a vibratory device.

The various embodiments of the vibratory device can comprise a body structure, an over-mold, and one or more vibratory mechanism(s) affixed to the body structure. The body structure can comprise at least a docking portion and a spine or a housing member, wherein the spine is preferably connected directly to the docking portion, however the docking portion may also connect to the spine through an extension section. The docking portion may be integrated into a portion of the housing member in the form of a compartment, or connected to the exterior of the housing member.

The spine can comprise one or more elongated members extending from the docking portion, wherein each of the one or more elongated members has a distal end to which a vibratory mechanism may be affixed. The spine may be a single elongated member, a primary elongated member with one or more secondary branches extending from the primary member at one or more branching points, or a plurality of elongated members having their proximal ends adjacent to each other, such as at the point each elongated member attaches to the docking portion. The principles of the present invention are therefore intended to cover the spine being a single trunk, a trunk with branches, or multiple trunks extending from approximately the same point of origin.

The spine is preferably formed of a single, solid elongated piece of resilient material, such as nylon, although additional separate elongated members may be attached to each other using methods such as ultrasonic welding, fasteners, or adhesives known to those skilled in the art.

In alternative embodiments, the spine may be connected to the docking portion by an extension section, which allows the docking portion to be located in a more convenient or comfortable location further from the elongated members and vibratory mechanism(s) when being worn by a user.

The docking portion and spine are preferably made of a resilient springy material that can elastically deflect when a force is applied to it and return to its original shape when the deforming force is removed. The material is a bio-compatible, medical-grade polymer, which is preferably a nylon, and more preferably nylon 12 or nylon 66. The resilient material forms a substructure that defines the particular shape of the body structure, and provides a spring tension that holds the vibratory device in position when properly worn by a user and presses the vibratory mechanism(s) against the erogenous zones of the wearer to facilitate transfer of the vibrations to the human surface that produces a pleasurable experience. The spine of the body structure is still enough to transfer the vibrations from the one or more vibratory mechanisms to the wearer for massaging application to a part of the human body, as well as through the vibratory apparatus as a whole. The material forming the spine can also be sufficiently stiff to produce constructive interference and a harmonic pulsating effect resulting from the interference of the vibrations and their relationship to the harmonic frequencies of the structure of the vibratory apparatus when two or more vibratory mechanisms affixed to the spine are operating. Control of the vibratory frequency, intensity and mode or pattern through the control module can produce different vibratory effects that propagate along the spine to the user(s) depending on the phase difference and intensities of the vibrations. The spine preferably has a spring constant of between approximately 0.2 lbs./in. and 0.7 lbs./in., and more preferably between approximately 0.45 lbs./in. and 0.65 lbs./in., and most preferably approximately 0.6 lbs./in. to create a restoring force when deflected.

The spine is preferably configured and dimensioned to conform to the female anatomy, and hold one vibratory mechanism against the G-spot and preferably two vibratory mechanisms against the clitoris, with a pressure that provides optimal stimulation. The elongated member which is intended to be inserted into the vaginal canal preferably has an approximately 'U' or 'C' like shape where the distal end of the member having an affixed vibratory mechanism curves back toward the proximal end of the member. The spine can thereby generate a clamping force that holds the device in place, and produces an equal and opposite force on the G-spot and mons pubis without applying direct pressure against the clitoris. The vaginal elongated member preferably has an overall length at least sufficient to reach from the clitoris to a position inside the vagina corresponding to the G-spot. The elongated vaginal member also has a thin cross-section and narrow width, so as to be as unnoticeable and interfere as little as possible during use. The vaginal member has a curvature that varies between approximately a 108 mm radius and an approximately 12 mm radius, and between approximately a 32 mm and 12 mm radius at the base of the "U" or "C" shaped curve, wherein the tightest radius varies between approximately a 16 mm and 12 mm radius.

The outer covering of a soft, pliable material can be formed over a portion or the entirety of the body structure during manufacturing as an over-mold. The soft, pliable over-mold covers at least a portion of the substructure material that forms the docking portion and spine, where the over-mold is a soft, spongy material with a suitable surface texture that cushions the harder substructure and provides a comfortable and enjoyable feel to the surfaces of the apparatus. The spine over-mold, wire channel over-mold covering, and docking portion over-mold may be formed as one integral piece or as separate pieces. The material is preferably a bio-compatible, silicone rubber, thermoplastic elastomer (TPE), thermoplastic rubber (TPR), or similar material as known to those of ordinary skill in the art, that can remain in a vaginal environment and be exposed to other bodily secretions and foreign fluids without being harmed or contaminated, and without itself harming or contaminating the wearer. The materials used for the over-mold and substructure meet the established safety requirements, such as those established by the FDA and other governing bodies in the US and abroad, for this manner of prolonged contact with the body, its mucus membranes and bodily fluids.

The docking portion of the vibratory device body structure is configured and dimensioned to releasably engage and be operatively associated with a control module, wherein the control module is easily removable from the docking portion of the body structure (as defined above). The docking portion can further comprise electrical contacts arranged in a predetermined pattern on one face of the docking portion or on a PCB that matches the arrangement of electrical contacts on one face of the control module housing or a PCB of the associated control module. The electrical contacts form an electrical path at the interface when the control module is mated with the docking portion, and an electrical circuit between the control module and vibratory mechanisms when the control module is mated with the docking portion.

A preferred embodiment of the docking portion is a control module housing that is configured and dimensioned to receive a control module, where the control module is inserted into one end or face of the control module housing. A control module that is received by and operationally associated with a control module housing of a vibratory device is preferably removable and more preferably easily removable from the control module housing of the vibratory device.

The substructure of the control module housing preferably comprises resilient members that form the edges and intersecting vertices of a cuboid shape, which is preferably a rectangular prism, while leaving one or more faces of the cuboid open. A plurality of the faces of the control module housing form openings, wherein at least one opening is dimensioned to allow a control module to be inserted into the control module housing, where the control module is preferably slidably inserted. At least a portion of the substructure and open faces of the control module housing can be covered by the pliable over-mold material. The pliable over-mold material can provide surfaces that allow tactile feel of the control module features when it is received in the control module housing, so that a user may feel the on-off switch or buttons of a user interface through the over-mold. The use of the pliable over-mold material over an opening of the substructure opposite the opening into which a control module is inserted allows a user to push on the pliable end to eject the control module from the housing. The vibratory device can also comprise a cap on the control module housing that can cover the open end.

In an embodiment, the control module can extend slightly beyond the opening in the control module housing to provide an edge that a user can grab to extract the control module from the housing.

The control module fits snuggly within the control module housing, and can be positively retained within the housing using catches or cantilevered snaps as known in the injection molding arts. The control module is preferably positively retained within the control module housing by a cap that also covers the open end of the control module housing, where the cap provides a seal for both waterproofing and hygiene. The cap may be secured to the end of the control module housing with a push fit, annular snap groove, or other means known in the molding arts.

Another embodiment of the docking portion of the vibratory device is a mounting plate that is configured and dimensioned to receive a control module, wherein the control module is releasably engaged with the face of the mounting plate by attachment components, wherein the mounting plate preferably comprises the projecting attachment components. The attachment components may include releasable snap fit joints, slidably associated slot(s) or groove(s) with a snap groove, hinges, or other releasable part engagements known to those of ordinary skill in the art. A control module that is releasably engaged and operationally associated with a mounting plate of a vibratory device is preferably removable and more preferably easily removable from the mounting plate. A mounting plate is a planar feature that does not fully encapsulate a control module, but is configured and dimensioned to be mechanically connected to a control module housing. The mounting plate preferably has mechanical features for releasably associating any suitably configured and dimensioned control module to the vibratory device. A mounting plate has electrical contacts associated with the face to which a control module would releasably attach arranged in a predetermined pattern that matches the electrical contacts of the control module. The associated electrical contacts form an electrical circuit between the control module and vibratory mechanisms when the control module is mated with the docking plate.

The vibratory device can further comprise a PCB with electrical contacts attached to the docking portion, and wiring to electrically connect the electrical contacts to the one or more vibratory mechanism(s) affixed to the body structure.

A preferred embodiment of the vibratory device comprises a body structure which comprises a control module housing and one or more elongated members extending from the control module housing, wherein the distal ends of the elongated members each have a vibratory mechanism that is powered and controlled by a removable control module held within the control module housing.

In a particular example of a preferred embodiment, one of the elongated members is configured and dimensioned for insertion into the vagina and is centrally situated between two other members, and has a greater length than the two elongated members on either side. This central elongated member is also referred to as the elongated vaginal member, and extends from the control module housing and bends around in a U-shaped curve underneath the plane of the connection to the control module housing and proximal ends of the elongated members. The two remaining members, also referred to as ears or first and second clitoral members, are preferably located on either side of the proximal end of the elongated vaginal member and are configured and dimensioned to position a vibratory mechanism located at the distal end of each of the first and second clitoral members against either side of the clitoris and against the labia.

In the preferred embodiment, the first and second clitoral members are connected to one another by a bridge of material, and then are connected to a flared proximal end of the elongated vaginal member slightly below the connection point of the centrally located vaginal member to the control module housing. The first and second clitoral members are shorter than the elongated vaginal member and each preferably extends in a straight line from the connection points to the distal ends on either side of the central member, and in a plane angled below the plane of the central member. The proximal ends 95 of each of the clitoral members are tapered and/or thin for flexibility, permitting motion in the vertical direction. The distal ends of each of the elongated members expand to form a cylindrical housing 65, 75 configured and dimensioned to receive a vibratory mechanism 80. The vibratory mechanism 80 can be cylindrical with either flat or curved ends, wherein the curved ends may be ovoid, hemispherical, torispherical, or other curved shapes.

The elongated member configured and dimensioned for insertion into the vagina is preferably between about 8 centimeters and 24 centimeters, more preferably between about 12 centimeters and 20 centimeters, and most preferably between about 15 centimeters and 17 centimeters in overall length. The members configured and dimensioned for contact with the clitoris are preferably between about 1 and 6 centimeters in length, and more preferably about 3.5 centimeters in length.

In the preferred embodiments, the elongated members have a greater width than thickness to permit flexibility in a vertical (up-down) direction to provide suitable pressure, while maintaining sufficient rigidity in the lateral (side-to-side) direction to maintain the elongated members in the proper position (where the directions are in relation to the device being worn by a female in a horizontal position).

In the preferred embodiments, the proximal ends of each of the clitoral members are tapered or thin for flexibility to permit motion in the vertical direction to maintain a reasonable amount of pressure on the labia and clitoris when being properly worn. The clitoral members preferably have a spring constant of between approximately 2-3 lbs./in., and more preferably a spring constant of approximately 2.8 lbs./in.

The elongated vaginal member has a central section between the proximal and distal ends including the curved portion of the 'U' shape that maintains a reasonable amount of pressure on the vaginal wall and G-spot when being properly worn. The radius of curvature at the curved portion of the 'U' shape is between approximately a 32 mm and 12 mm radius. The radius of curvature at the straighter segment of the 'U' at the proximal end of the spine is approximately 107 mm.

In one preferred embodiment, the combination of the pressure produced by the elongated vaginal member, the control module housing, and clitoral member(s) when present provide a clamping force that acts to hold the apparatus in position against the G-spot and mons pubis when being properly worn. In another preferred embodiment, the vaginal member alone provides the clamping force that holds the apparatus in position when being properly worn. In a preferred embodiment, the shape and positioning of the elongated vaginal member provides a sufficient clamping force, while the attached control module housing hold on to the mons pubis above the vagina to allow the device to remain in position during use. The placement of the control module and housing can further act to anchor the device in position. Furthermore, the use of the vaginal member and positioning of the control module to provide the clamping force allows the clitoral ears to apply a different force, which can be independently controlled and much lighter than the clamping force, to the clitoris. This is distinguished this embodiment from arrangements that produce equal and opposite forces to the G-spot and clitoris.

The vibratory mechanism(s) can be a fitted with an eccentric rotating weight, a solenoid actuator, a piezoelectric actuator, or other small vibration generating mechanism known to those in the art. An example of a preferred vibratory device is a pan motor, and another example is a bullet, as known in the art. The outside shape of the vibratory mechanism may be cylindrical with either flat or curved ends, wherein the curved ends may be either ellipsoidal, ovaloid, hemispherical, or torispherical. Such vibratory mechanisms may also have a bullet-like shape. The vibratory mechanism(s) are affixed at the distal ends of the elongated members to provide pleasurable vibrations to stimulate the erogenous zones in contact with the vibratory mechanism(s). In some embodiments, the vibratory mechanisms affixed to the elongated clitoral members may be of a different size or different type, as discussed above, than the vibratory mechanism affixed to the distal end of the elongated vaginal member. The wiring to the vibratory mechanism(s) can pass from the control module housing to a junction box, and from the junction box to the vibratory mechanism(s) attached to the one or more elongated members, where the vibratory mechanism can be electric motors with off-center weights. Preferably discrete wiring is used between the proximal and distal ends of the spine, where the wiring runs through a trough or channel in the spine to the junction box. Alternatively, a flex circuit can used, or ribbon cable and a connector. The junction box at the proximal end of the vaginal member can have a PCB to which the wiring is connected, and that can be used to connect the wiring from the docking portion to the wiring running along the spine. The over-mold can cover the spine, channel(s), junction box, the wire channel in the underside of the control module housing, and the control module housing as a single continuous layer that seals the wiring in place. Further, in some embodiments, the vibratory mechanism(s) may be affixed in positions other that at the distal end of the member(s).

The over-mold at the distal end of the vaginal elongated member bows away from the internal surface, such that it has a convex shape along the interior surface and a concave shape along the exterior surface, when viewed along the axis of the elongated member. The presence of a vibratory mechanism affixed to the distal end of the vaginal elongated member may also form an additional convex protrusion, bulge, or hump along the axis of the elongated member. The convex upper surface is preferably positioned 1-3 inches inside a female's vagina when being properly worn, which should coincide with the G-spot. The pliable over-mold material extends beyond the resilient spine material and tapers down to a thinner flat portion at the edges of the over-mold that can conform to the portion of the wearer's body that it is in contact with, wherein the over-mold portion provided a larger surface through which a massaging operation from a vibratory mechanism is applied at least to the person wearing the device, and possibly a sexual partner if the wearer and partner are engaged in intercourse. The overall shape and texture also provides a contoured surface that allows a partner's penis or other penis shaped object to be more easily and comfortably inserted into the vagina along with the elongated vaginal member. In addition, the convex portion of the distal end provides a protrusion that focuses the vibration and pressure upwards towards the G-spot. Furthermore, the exposure of the spinal material, which has a higher durometer (i.e., is harder) than the over-mold material, on the upper side of the convex portion conveys the vibrations more efficiently to the erogenous zones than if it is covered with a softer over-mold material. The spinal material is preferably a nylon. The combination of the concave/convex shape and flattened edges at the distal end of the elongated member distinguishes the overall tortoise shell-like shape of the distal end of the vaginal elongated member from a three-dimensional teardrop shape. In a preferred embodiment, the entire interior curvature of the vaginal member has the spine material exposed, so that the harder material is in contact with a woman's body along the entire length of the vaginal member. The other portions of the over-mold cushions the more rigid substructures of the docking portion and spine, and in particular the corners and edges. The over-mold also servers to seal the apparatus from liquids, assists in holding the subcomponents of the apparatus together, provides a pleasurable tactile feel, and provides vibration conduction benefits for massaging application to a part of the human body.

In a preferred embodiment, the body structure comprises a flexible spine that can be elastically deformed in a manner that allows distortion of the shape and repositioning of the elongated members of the apparatus in relation to the control module housing and each other, and an outer covering of a soft, pliable material that provides a comfortable and enjoyable feel to the surfaces of the apparatus for massaging application to a part of the human body. The flexion of the spine permits the shape of the device to conform to the user's particular anatomy and positioning preferences, while maintaining the desired amount of pressure applied to both the internal wall of the vagina and external genitalia. The spine is preferably made of a nylon material, but could alternatively be made of another material with the appropriate properties of resilience and bio-compatibility.

In an alternate embodiment, the body structure can comprise a semi-rigid spine that can be plastically deformed in a manner that allows the adjustment of the shape and repositioning of the elongated members of the apparatus in relation to the control module housing and each other, and an outer covering of a soft, pliable material that provides a comfortable and enjoyable feel to the surfaces of the apparatus. Adjustment to the plastically deformable semi-rigid spine permits the user to change the shape of the device to conform to the user's particular anatomy and positioning preferences, while maintaining the desired amount of pressure applied to both the internal wall of the vagina and external genitalia.

The docking portion substructure and spine may be injection-molded as a single integral unit, wherein the elongated members of the spine extend out from a wall or edge member of the control module housing as a unitary molded structure. The body structure may also be assembled from multiple components, wherein the elongated members of the spine are affixed to the control module housing by soldering, welding, vibratory welding, snaps and/or with fasteners and/or adhesives. In a preferred embodiment, the body structure is a combination of a unitary molded substructure and affixed components, which are over-molded to seal the unit together, and provide tactile and vibration conduction benefits.

In a preferred embodiment, the elongated vaginal member of the spine and control module housing are formed as a single unit with the proximal end of the spine for the elongated vaginal member having a greater width at the point that the elongated vaginal member joins with and extends from control module housing wall. This wider portion at the proximal end of the elongated vaginal member tapers down to a width that would fit comfortably against or between the vulva before reaching the U-shaped bend in the vaginal member. The width of the spine at the U-shaped portion of the vaginal member is preferably between ⅛th and ½ of an inch, and more preferably between 3/16th and 5/16th of an inch, and most preferably about ¼ of an inch. The thickness of the spine is preferably less than the width.

In the preferred embodiment, the spine for the ears or first and second clitoral members is formed as a single piece separate from the rest of the body structure, and affixed to the face of the wider portion at the proximal end of the vaginal member spine that faces the wearer when the vaginal member is properly inserted into the vagina. The spine for the ears are therefore affixed from and extend beneath the proximal end of the vaginal member. The spine portions of the ears may also each be formed separately from each other and individually attached to the wider portion of the spine of the vaginal member. When the ears are affixed to the vaginal member spine with fasteners the vaginal member spine will be molded with holes or other suitable openings 62 to accept the fasteners. Fasteners known to those of ordinary skill in the art, such as threaded screws, nuts and bolts and/or rivets, may be used to affix the spine of the ears to the proximal end of the spine of the elongated vaginal member. In another embodiment, posts integral with the top face of the proximal end of the ears (see FIGS. 17A-17B) can be inserted into the holes in the proximal portion of the elongated vaginal member (see FIG. 16). A suitable adhesive may be used alone, or in addition to the fasteners to provide a stronger, more durable bond between the components, and improving the transfer of vibrations between the components.

In another embodiment of a body structure, the spine comprises a longer curved leg that branches into two arms to form a curved 'Y' shape, so that the device has three distal end where a vibratory mechanism could be affixed. The curved leg is preferably longer than the two branching arms. This embodiment can further comprise an extension section that is a third branch off of the longer leg of the 'Y', wherein the third branch preferably extends away from the longer leg in the plane of the curve. A docking portion connects to the extension section at the end opposite the connection to the longer leg, and is preferably oriented perpendicular to the plane of the curve. The two arms lie in the same plane and form an acute angle with the vertices at the branching point. The docking portion in this embodiment is preferably a control module housing.

Examples of different embodiments of each of the various components as well as different embodiments of the overall apparatus will now be described in more detail with reference to the figures. It should be understood that these drawings only illustrate some of the preferred embodiments, and do not represent the full scope of the present invention for which reference should be made to the accompanying claims.

Figure 1:
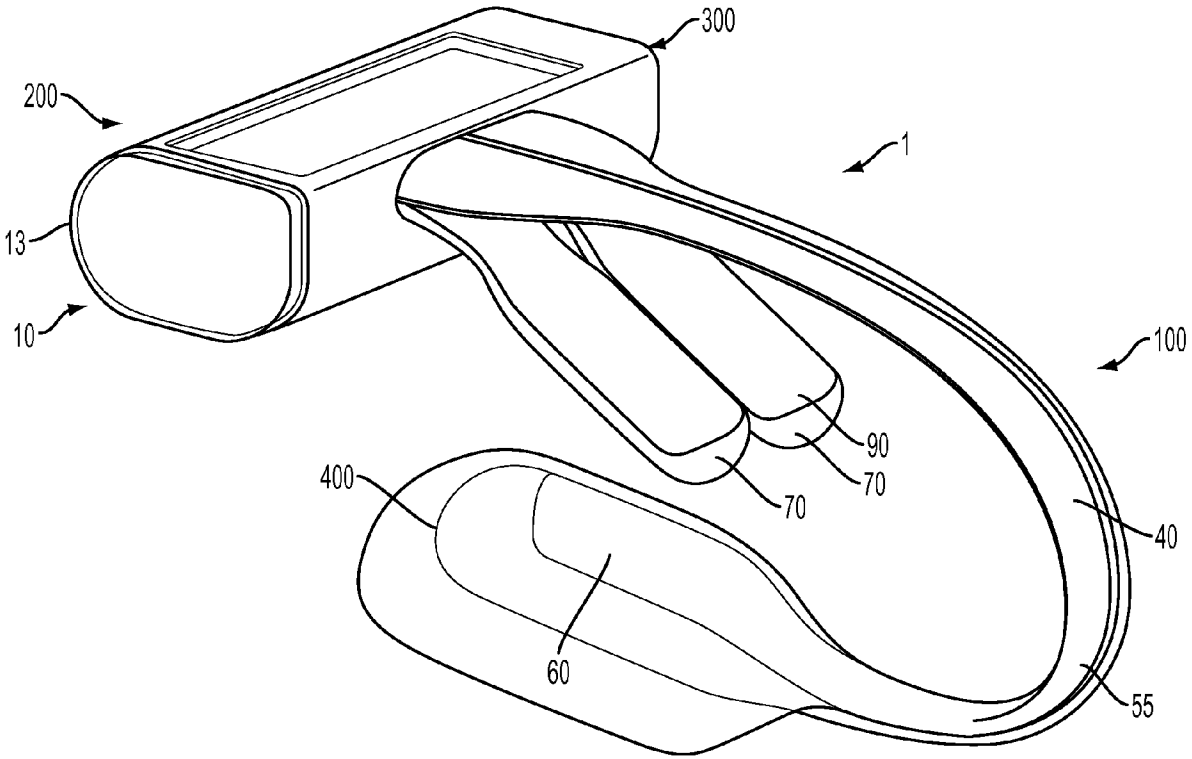
FIG. 1 is a shaded perspective of an embodiment of the assembled vibratory apparatus.

FIG. 1 is an example of a preferred embodiment of an assembled vibratory apparatus 1 showing the vibratory device 100 comprising a control module housing 10 containing a control module 200, a connected spine comprising a 'U'-shaped vaginal member 40 and two clitoral members 70, also referred to as ears, and a cap 300. The elongated clitoral members are affixed to and branch away from elongated vaginal member. In the embodiment shown in FIG. 1, the distal end of the vaginal member is below the clitoral members, whereas in a more preferred embodiment the distal end of the vaginal member extends to a position below the control module housing.

It can be seen in FIG. 1 that the preferred shape of the control module housing 10 is essentially a rectangular prism having rounded edges and corners and a rounded front face 13, although other cuboid, cylindrical, spherical or ovoid shapes and configurations could be used without deviating from the scope of the invention. This particular configuration and other smoothed and rounded shapes avoid sharp corners and edges that may poke, pinch, or scratch a wearer or partner during use of the device. In this preferred embodiment, the presence of a soft, pliable over-molding material 400 (previously described above) on at least the corners, edges and particular skin-contact surfaces further protects the wearer and partner, while adding to the pleasurable feel and overall experience of the different embodiments of the present invention, however an over-mold is not required in all embodiments.

The rectangular control module housing is preferably approximately 54 mm×25 mm×15 mm, and the control module body is preferably approximately 51 mm×20 mm×10 mm, such that the control module is easily inserted and easily removable from the control module housing without having excessive play. The control module body and control module housing have standardized dimensions to allow interchangeability between all devices, and preferably have a polarized shape that only allows the control module to be inserted into the housing one way.

FIG. 1 further illustrates the rounded shell-like shape of the distal end 60 of the elongated vaginal member that is configured and dimensioned to be inserted into a female user's vagina, and the U-shaped portion 55, that curves from approximately the front of the pubis past the vulva to the vaginal opening. The two ears are directed downward towards the labia minora and clitoris, and straddle the clitoris when being worn by a female. The distal end 60 of the vaginal member 40 and the distal ends 90 of the clitoral members 70 are thereby directed towards each other, and apply a simultaneous pressure on the internal and external female genitalia, as well as act to hold the apparatus in position during use in this particular example.

When properly worn, as shown in FIG. 26, the distal end of the elongated vaginal member is in contact with and applies pressure against the G-spot; and a vibratory mechanism affixed to the distal end of the elongated vaginal member provide vibrational stimulation to the female G-spot. The force against the G-spot is then counter-balanced by the force of the control module housing against the mons pubis. The clitoral members are also shown pressing against the clitoris and labia.

The elongated vaginal member preferably has a spring constant of between approximately 0.2 lbs./in. and 0.7 lbs./in., and more preferably between approximately 0.45 lbs./in. and 0.65 lbs./in., and most preferably approximately 0.6 lbs./in. to create a restoring force when deflected.

Figure 2:
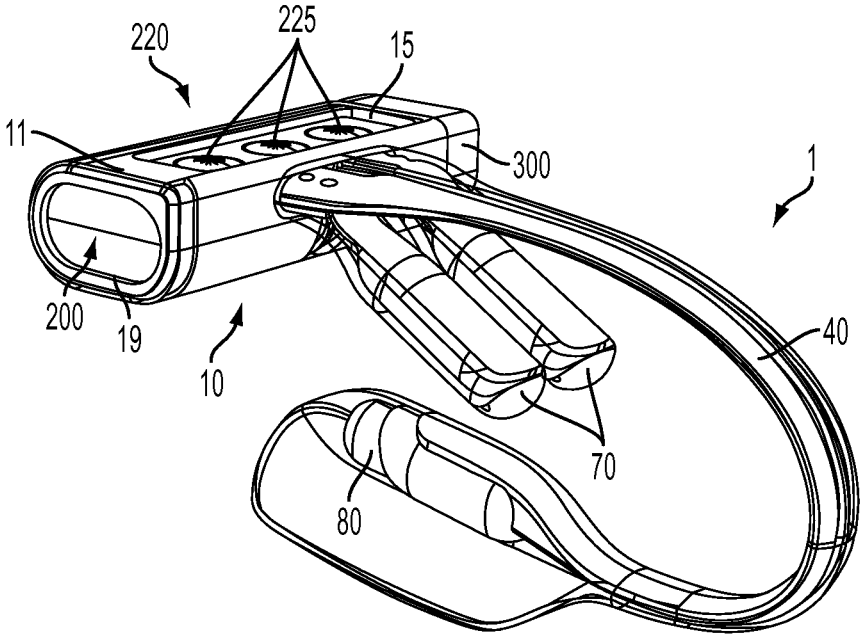
FIG. 2 is a perspective line drawing of an embodiment of the assembled vibratory apparatus having a first body structure.

FIG. 2 is a perspective line drawing of an embodiment of the assembled vibratory apparatus 1 previously illustrated in FIG. 1. Additional details of a preferred embodiment of the present invention can be seen. The user interface 220 of the control module 200, including a plurality of buttons 225, is visible within a window 15 in the top wall 11 of the control module housing 10. In another embodiment, a pliable over-mold can cover the window 15 while allowing a user to see and feel the underlying buttons. Also in the illustrated example, a cap 300 covers the module side window opening 17 at the left end of the control module housing 10, as viewed in FIG. 2, and may positively retain the control module 200 within the control module housing 10. The module opening 19 and cap 300, however, may be located at either end of the control module housing in the preferred embodiment, or the front face without deviating from the scope of the invention.

Figure 3A:
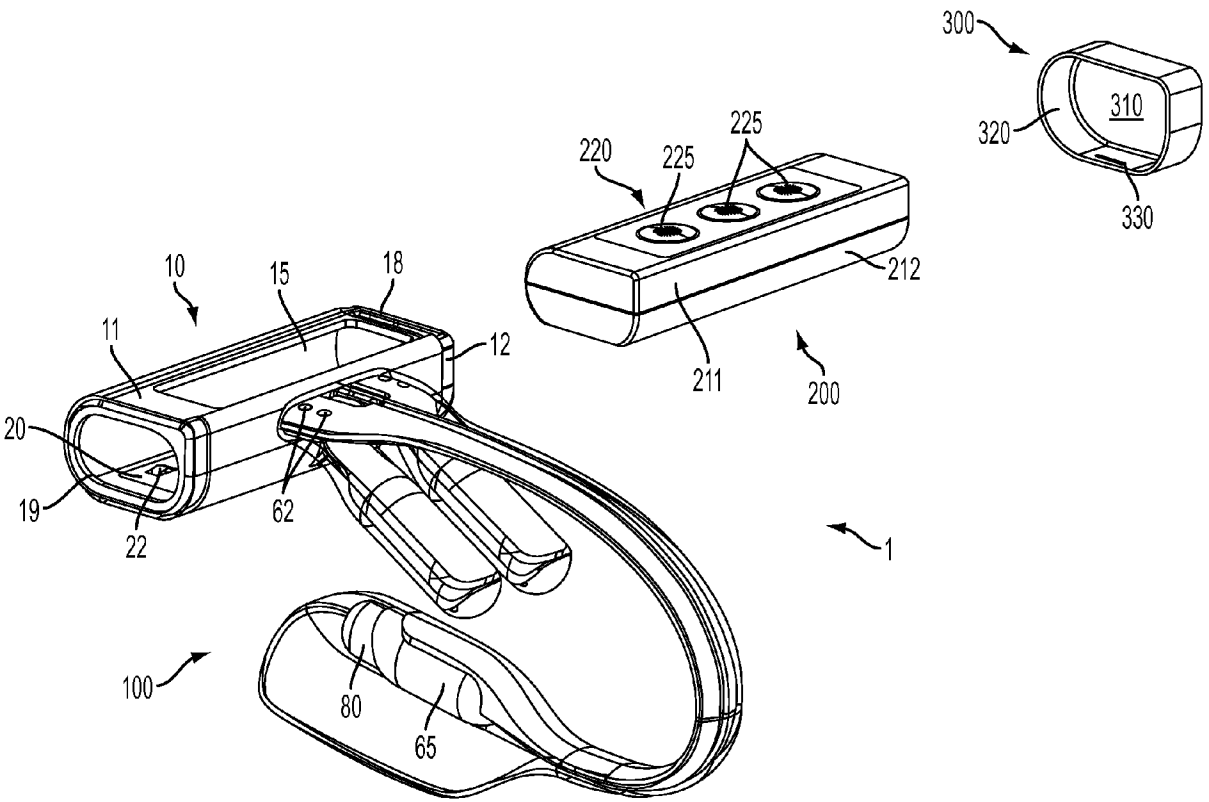
FIG. 3A is an exploded line drawing of an embodiment of the vibratory apparatus.

FIG. 3A is an exploded line drawing of an embodiment of the personal massage apparatus 1 showing the vibratory device 100, control module 200 and cap 300 separately. In the particular embodiment illustrated, it can be further seen that the control module housing 10 comprises a PCB 20 having a plurality of electrical contacts 22, where the PCB 20 is affixed to the internal face of the bottom wall 13 of the control module housing 10. Electrical wiring 28 between the electrical contacts 22 and the vibratory mechanisms 80 provided electrical paths between the control module 200 and the vibratory mechanisms 80 to power and control the frequency, vibratory mode or pattern and intensity of vibrations of the vibratory mechanisms. The electrical contacts 22 of the control module housing 10 are arranged in a predetermined pattern that is designed to match an arrangement of electrical contacts 222 on the bottom face of a control module 200. Preferably, each individual vibratory mechanism 80 affixed to the vibratory device 100 is controlled separately, however some embodiments may provide only a single control signal to all of the vibratory mechanisms.

The control module body preferably comprises two molded shells that can be affixed to each other, although more parts could also be assembled to form a control module body, as would be known to persons of ordinary skill in the forming or molding arts. The control module 200 shown in FIG. 3A can be seen to comprise an upper body shell 211 and a lower body shell 212 forming the exterior body, and a user interface 220 having three buttons 225 in this particular illustrated example. The control module body may also comprise physical/mechanical features that can releasably engage corresponding features on a docking portion of a vibratory device, where such features may be T-slots, grooves, catches such as cantilevered or torsion snaps, or other designs, as known in the injection molding arts. The attachment features are preferably arranged in a manner that would allow the control module to be attached to a docking portion in only one orientation. The attachment features can also be magnets or Velcro™. The magnets can be located on the control component, on the vibrator component, or on both the control component and vibrator component to form a physical connection. Preferably the magnets are on the mating face of the control module and/or mating face of the docking portion to facilitate fastening of the control module to the vibratory device, such that mating faces of the control module and docking portion are held together by the magnets. The electrical contacts on the control module are also held in contact with the electrical contacts of the docking portion to create an electrical path between the two components. In a similar manner, Velcro™ can be used to mechanically connect a control component to a vibrator component by forming physical connections between the two different Velcro™ surfaces attached to the mating surfaces of the control component and the vibrator component.

Figure 3B:
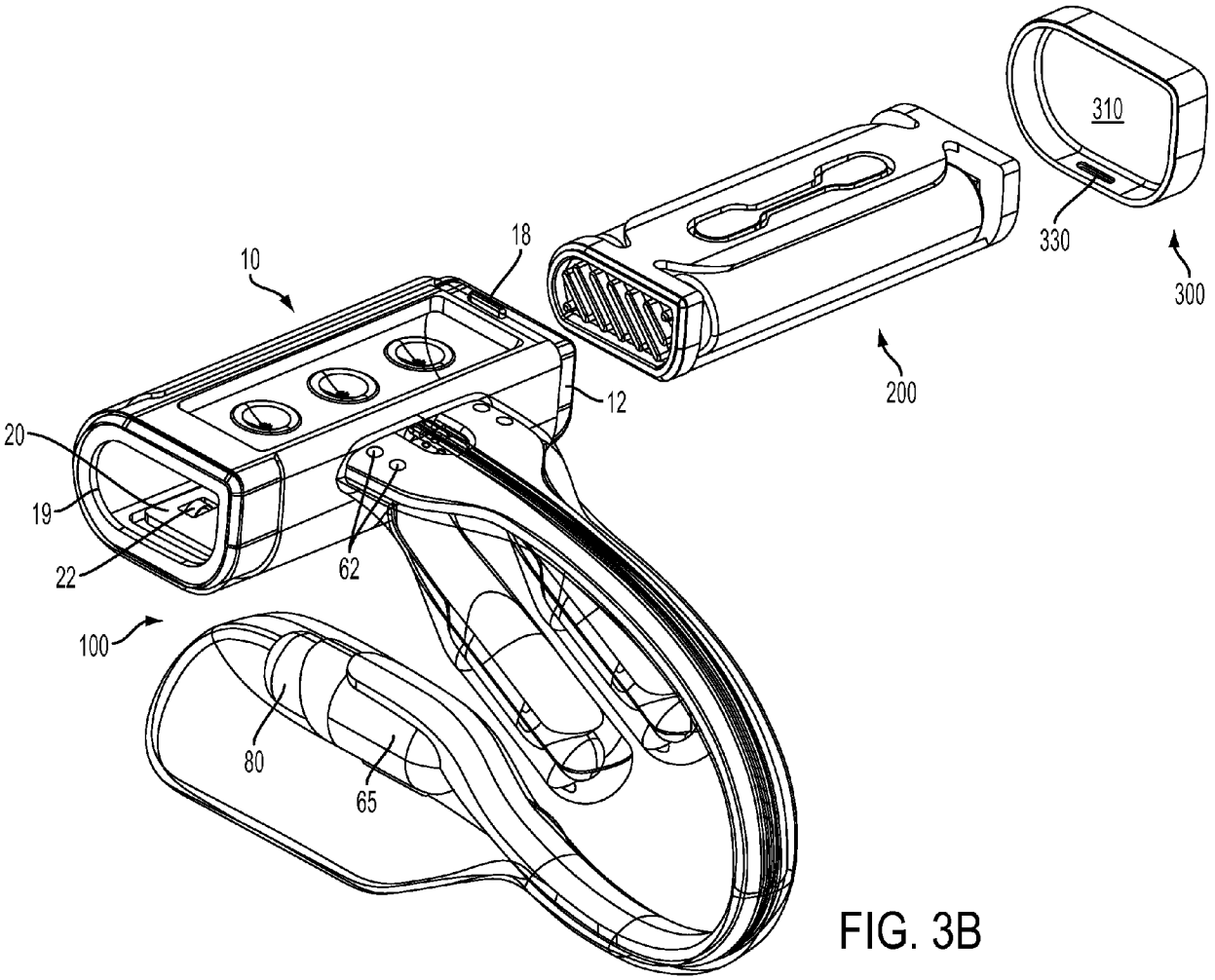
FIG. 3B is an exploded line drawing of a more preferred embodiment of the vibratory apparatus.

FIG. 3B is an exploded line drawing of a more preferred embodiment of the personal massage apparatus showing the vibratory device 100, control module 200 and cap 300 separately. In the particular embodiment illustrated, it can be further seen that the distal end of the vaginal member 65 is located in a more preferred position below the control module housing 10. The control module housing 10 comprises a PCB 20 having a plurality of electrical contacts 22, where the PCB 20 is affixed to the internal face of the bottom wall 13 of the control module housing 10. Electrical wiring 28 between the electrical contacts 22 and the vibratory mechanisms 80 provides electrical paths between the control module 200 and the vibratory mechanisms 80 to power and control the frequency, vibratory mode or pattern and intensity of vibrations of the vibratory mechanisms. The electrical contacts 22 of the control module housing 10 are arranged in a predetermined pattern that is designed to match an arrangement of electrical contacts 222 on the bottom face of a control module 200. Preferably, each individual vibratory mechanism 80 affixed to the vibratory device 100 is controlled separately, however some embodiments may provide only a single control signal to all of the vibratory mechanisms.

The cap 300 is shown to comprise a closed face 310 and side walls 320 configured and dimensioned to mate with the open end of the control module housing 10. A preferred embodiment of the cap 300 further comprises a snap catch/groove 330 formed in at least one of the interior faces of the cap side walls 320 to positively engage a groove or lip 18 in a corresponding face of the control module housing, or the engagement of the cap to the control module housing can be by an annular snap-fit joint (not shown), as known in the plastic molding art. In the example of a preferred embodiment shown in FIG. 3, the walls at the end of the control module housing with the module opening 17 are recessed 12 to account for the added thickness of the cap sidewalls, so that the exterior surfaces of the cap sidewalls 320 are flush with the exterior surfaces of the control module housing 10. When the cap 300 is operatively associated with the control module housing 10, the cap 300 seals the housing 10 for waterproofing and to maintain a hygienic device. The combination of the control module housing walls, over-mold 400, and pliable cap 300, seals the control module housing from liquid penetration when the cap 300 is operatively associated with the control module housing.

Figure 4:
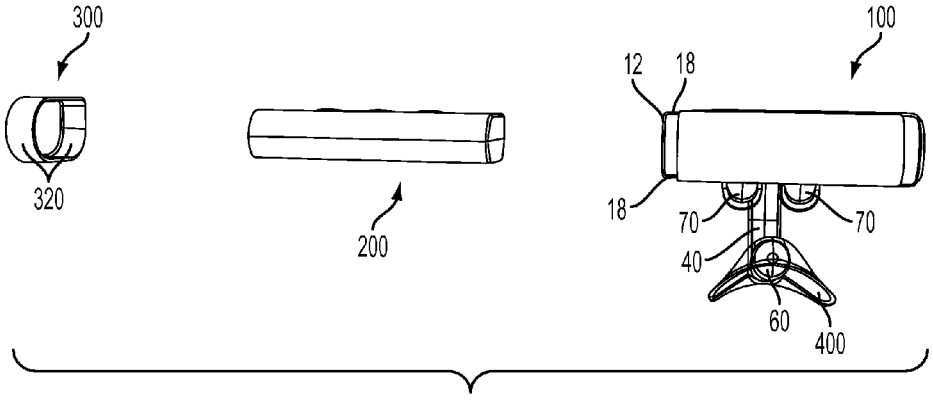
FIG. 4 is an exploded line drawing of the front view of an embodiment of the invention.

FIG. 4 is an exploded line drawing of the front view of an embodiment of the invention showing the symmetrical positioning of the clitoral members 70 in relation to the elongated vaginal member 40. The preferred tortoise shell-like shape of the distal end 60 of the vaginal member is shown having a concave lower surface and a convex upper surface. This convex shape provides contact between the vibratory mechanism and the vaginal wall including the G-spot, while the concave side allows insertion of a partner's penis or other similarly shaped sexual device or object into the vagina while being in contact with the vibratory device. The concave side of the particular illustrated embodiment has a shallow spoon-like shape. The concavity of the lower surface allows the convex shape of a penis or penis-like object to nestle naturally into the distal end of the vaginal member. This combination of shapes provides the benefit that the vaginal member and penis or other object do not push each other aside, thereby causing a loss of contact of the vaginal member with the G-Spot.

In addition, FIG. 4 shows lips 18 for catching the snap grooves 330 on the cap 300 of the recessed portion 12 of the control module housing walls 11, 13, 14, 16.

Figure 5:
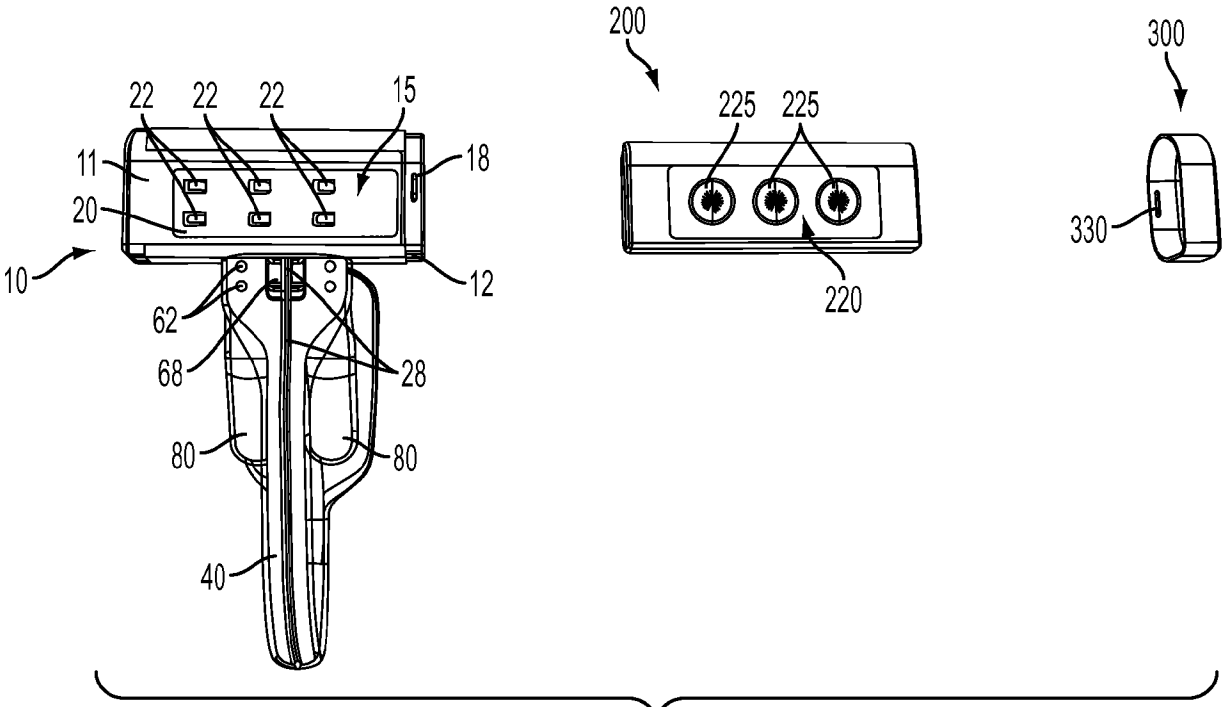
FIG. 5 is an exploded line drawing of the top view of an embodiment of the invention.

FIG. 5 is an exploded line drawing of the top view of an embodiment of the invention. The electrical contacts 22 can be seen on the PCB on the bottom face of the control module housing. The lips 18 can also be seen on the recessed portion 12 of the control module housing. The buttons 225 of a user interface 220 are located on the top face of the control module 200, which aligns with the window opening 15 in the top face 11 of the control module housing 10. FIG. 5 also illustrates the polarized cuboid shape of the control module and cap 300 having a rounded front face and a flattened rear face 16 that can only be oriented one way for insertion into the polarized control module housing.

Figure 6:
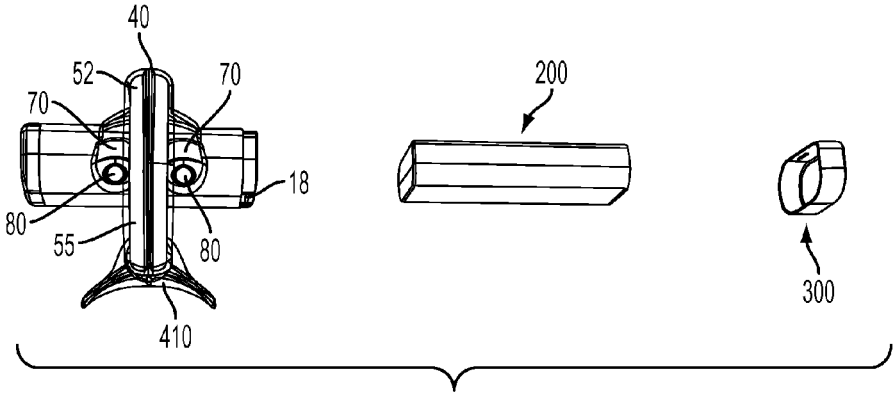
FIG. 6 is an exploded line drawing of the back view of an embodiment of the invention.

FIG. 6 is an exploded line drawing of the back view of an example of an embodiment of the invention. In particular, the curved 'U' shaped portion 55 of the elongated vaginal member can be seen to end in a concave distal end 410 formed by the spine and over-mold, which can be seen to have a shallow spoon-like shape. The elongated vaginal member 40 in this particular example defines a vertical plane perpendicular to the horizontal plane of the clitoral members and control module housing. The elongated clitoral members 70 can be seen to be symmetrically placed on either side of the vaginal member 40, and below the upper portion 52 of the curved vaginal member 40. Each of the elongated clitoral members has a vibratory mechanism 80 affixed to its distal end. A lip 18 for catching a snap groove 330 (not visible) on the cap 300 can be seen on the bottom of the recessed portion 12 of the control module housing wall 11.

Figure 7:
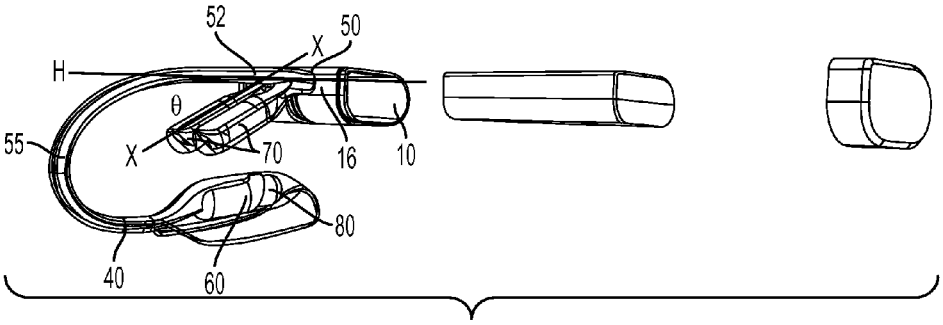
FIG. 7 is an exploded line drawing of a perspective view from the back of an embodiment of the invention.

FIG. 7 is an exploded line drawing of a perspective view from the back of an example of an embodiment of the invention. The proximal end 50 of the 'U' shaped elongated vaginal member 40 joins the rear face 16 of the control module housing 10. The clitoral members 70 extend below the upper portion 52 of the vaginal member 40. The axis X-X of each clitoral member forms an acute angle 'θ' with the horizontal plane 'H' of the upper portion 52 of the vaginal member 40 and control module housing 10. The elongated clitoral members can independently flex towards and away from plane 'H,' such that the angle 'θ' that each clitoral member makes with plane 'H' increases and decreases, but the clitoral members do not flex from side to side. The U-shaped portion 55 of the elongated vaginal member 40 curves away from and below the plane 'H' and back in the direction of the control module housing 10, so the distal end 60 of the elongated vaginal member 40 is located approximately below the elongated clitoral members 70, in that particular embodiment. A vibratory mechanism 80 is affixed to the distal end 90 of each clitoral member 70, and to the distal end 60 of the vaginal member. The vibratory mechanisms affixed to the clitoral members may be smaller than the vibratory mechanism affixed to the distal end of the vaginal member in some embodiments of the present invention.

Also illustrated in FIG. 5 is an opening in the end of the control module housing having differently curved surfaces for the front and back faces. The differently curved faces results in a polarized shape to the control module housing that allows the matching shape of the control module to be slidably inserted in only one orientation. The cap can be pressed over the recessed edge of the control module housing walls to form a liquid tight seal, and to retain the control module in the control module housing. The cap can be made of the same pliable, elastic materials, as the over-mold, and more preferably is made of the same higher durometer materials as the spine (discussed above).

Figure 8:
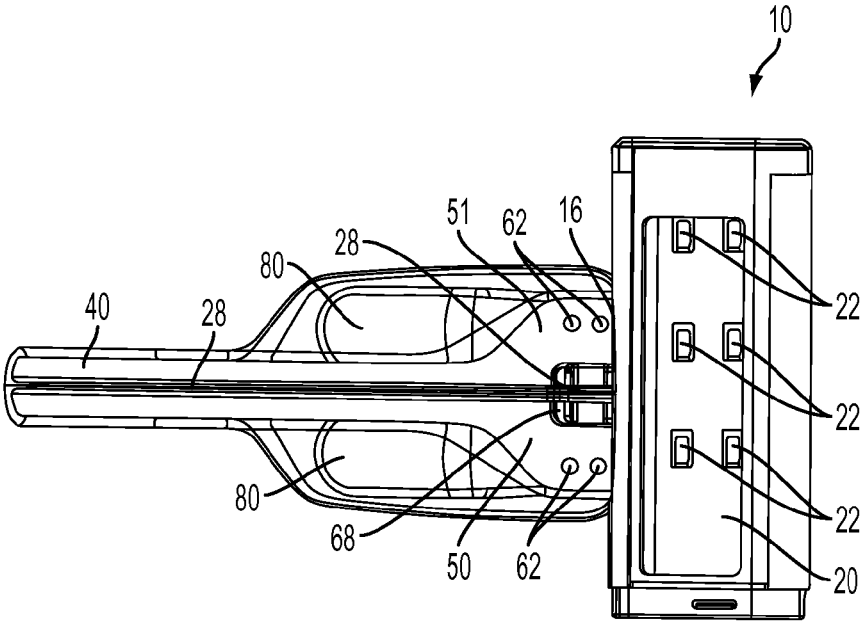
FIG. 8 is a line drawing of the top view of an embodiment of the vibratory apparatus with the control module removed, showing the PCB board and contacts within the control module housing.

FIG. 8 is a line drawing of the top view of an example of an embodiment of the vibratory device showing the PCB 20 and contacts 22 within the control module housing, as well as the flared shape of the proximal end 50 of the elongated vaginal member joining the control module housing 10 along the top edge of the rear face 16. A predetermined pattern of electrical contacts 22 located on the control module housing PCB 20 can be seen through the window opening 15 in the top face of the control module housing 10. Wiring 28 forming the electrical connection between the electrical contacts 22 in the control module housing 10 and the vibratory mechanisms 80 affixed at the ends of each elongated member can be seen in a junction box opening 68 at the proximal end 50 of the elongated vaginal member 40. The wiring from the control module housing around the spine to the distal vibratory mechanism can be discrete wires or a flex circuit joined at a PCB in the junction box. The wiring follows a channel molded into the spine from the junction box to the one or more vibratory mechanisms affixed to the spine. This opening can be filled with epoxy and/or over-mold material once the wires 28 are inserted and the electrical connections are made to the vibratory mechanisms 80. The contacts on the control module PCB, control module housing PCB, and wiring form an electrical path for delivering power from the control module to the vibratory mechanisms.

Openings 62 in the flared portion 51 of the elongated vaginal member 40 allow molded posts with or without annular snaps or grooves, or attachment components (e.g.: screws, rivets, pegs, dowels, etc.) to be inserted for attaching the proximal ends 95 of the elongated clitoral members 70 to the underside of the proximal end 50 of the elongated vaginal member 40.

Figure 9A:
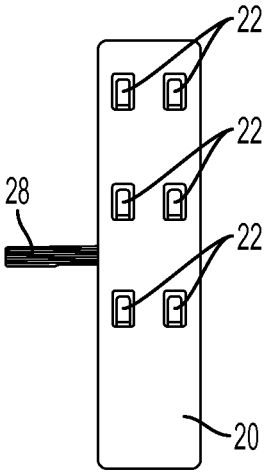
FIG. 9A is a line drawing of the top view of an embodiment of the PCB board, contacts, and wiring for the vibratory apparatus.
Figure 9B:
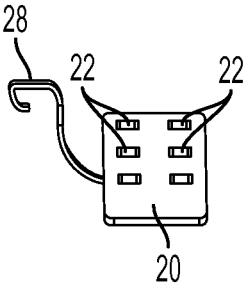
FIG. 9B is a line drawing of a perspective view of an embodiment of the PCB board, contacts, and wiring for the vibratory apparatus.

FIG. 9A is a line drawing of the top view and FIG. 9B is a line drawing of a perspective view of an embodiment of the PCB 20, contacts 22, and wiring 28. The predetermined pattern of the contacts 22, control module housing PCB 20, and connecting wiring 28, is illustrated in each figure, where three of the contacts could correspond to output channels A, B, and C. The wiring shown in FIGS. 9A-B can preferably connect to a junction box in the proximal end of the elongated vaginal member, or the wires from the electrical contacts can extend continuously to the one or more vibratory mechanisms attached to the spine. The junction box preferably has a small PCB to which the wiring is connected to form a bridge between the wiring from the control module housing and the wiring from the distal ends of the elongated members of the spine, to form an unbroken electrical path from the electrical contacts 22 to the vibratory mechanism(s) 80. Wiring from the junction or contacts can extend along a channel molded into the spine to each vibratory mechanism. Such a channel can be covered and sealed by the over-mold material.

Figure 10:
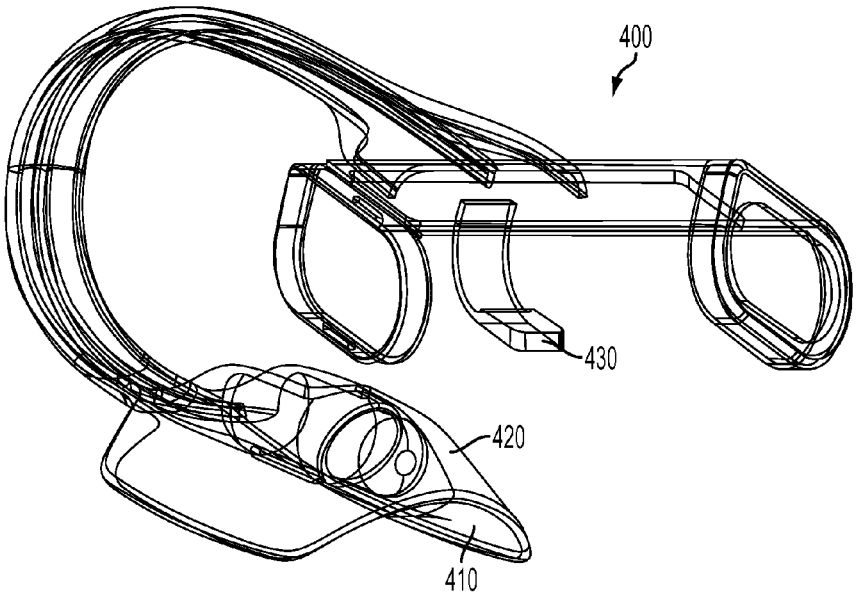
FIG. 10 is a line drawing of the front perspective view of an embodiment of the over-mold.

FIG. 10 is a line drawing of the front perspective view of an embodiment of the over-mold 400 that would be covering the docking portion and spine portion of the substructure of this particular illustrated example. The over-mold 400 in this example covers the edges, left side end and part of the top face of the control module housing, as well as covering the outwardly-facing side of the adjoining elongated vaginal member, and forming the curved shell with a concave bottom face 410 and convex top face 420 covering the distal end and affixed vibratory mechanism of the elongated vaginal member. The over-mold covering the distal end of the elongated vaginal member also provides a larger surface area for contact with the vaginal wall on the convex side 420 and an inserted penis on the concave side 410, through which a massaging sensation from the operation of one or more vibratory mechanisms is applied to each person in contact with the distal end of the vaginal member. The left side end is open to allow insertion of a control module into a module housing. An additional separate wire-channel over-mold covering 430 for a control module housing wiring channel is also shown.

Figure 11:
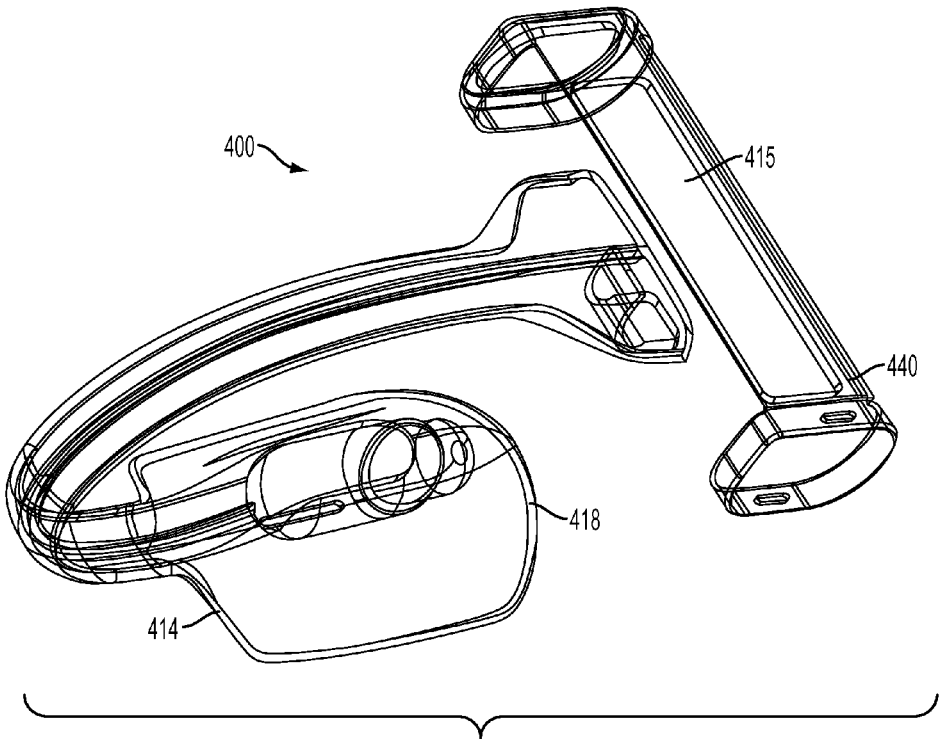
FIG. 11 is a line drawing of the top-back perspective view of an embodiment of the over-mold.

FIG. 11 is a line drawing of the top-back perspective view of an embodiment of the over-mold 400 showing the curved shape of the shell-like covering at the distal end of the elongated vaginal member. The shell shaped covering in this example extends outward from the elongated vaginal member at a point closer to the 'U' curve to form a flared proximal edge 414, and has a rounded distal edge 418. The shell covering also helps to retain and seal the vibratory mechanism in the cylindrical housing at the end of the elongated vaginal member. The control module housing over-mold 440 is illustrated having a user interface window 415 that is configure, dimensioned and located to match the window in the top face of the control module housing window. In other embodiments, however, the control module housing over-mold 440 could have an over-mold layer covering the control module housing window. The over-mold 400 is preferably translucent, and may be clear or have a colored tint to it. The over-mold covering the control module housing window is preferably thin enough for a user to have a tactile sense of the user interface controls, such as the buttons, through the over-mold layer. The spine, wire channel, and docking portion over-molds in this example are illustrated as separate pieces, although the over-mold could be formed as a single piece.

Figure 12:
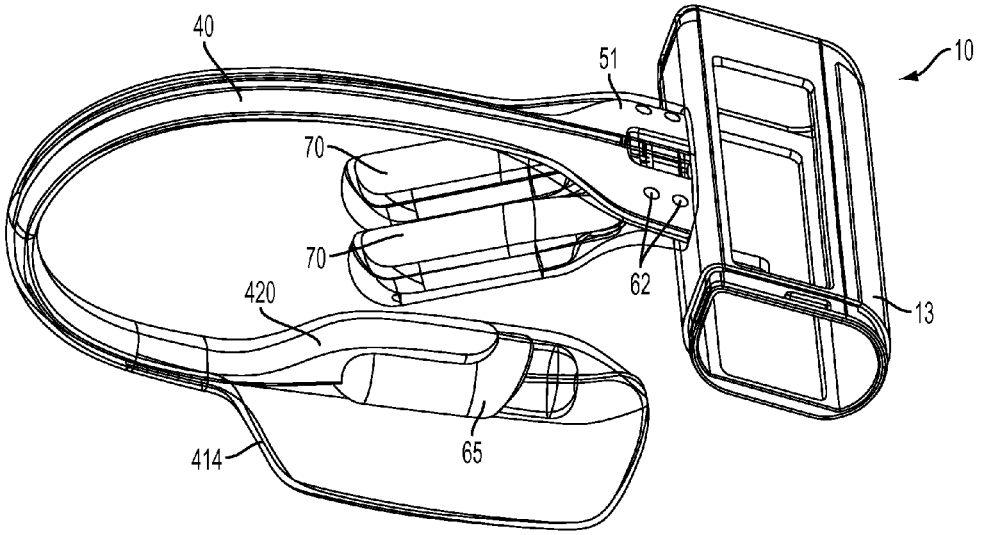
FIG. 12 is a line drawing of the right side perspective view of an embodiment of the spine and over-mold showing the control module housing, vaginal member, and ears.

FIG. 12 is a line drawing of the right side perspective view of an embodiment of the spine, control module housing, and over-mold showing the control module housing 10, vaginal member 40, ears 70, and over-mold 400, and in particular the shell shape of the over-mold covering at the distal of the elongated vaginal member 40. Each of the elongated clitoral members 70 also end in a cylindrical housing 75 to hold a vibratory mechanism. The tortoise shell shape of the over-mold shell covering at the distal end of the elongated vaginal member is convex along the upper surface 420, and concave along the lower surface to provide contact against the vaginal wall and G-spot while allowing the insertion of a penis or penis-shaped object, when the device is being worn by a female. The over-mold tapers down to form edges. The shell has a flared proximal edge 414, and rounded distal edge 418, although the distal edge may also be essentially straight. The distal edge 418 of the over-mold covering the vaginal member may end abruptly having the approximately straight edge to provide additional retention within the vagina.

The vibratory mechanism illustrated in this example is affixed in the vaginal cylindrical housing 65 at the distal end 60 of the elongated vaginal member 40. The curved front face 13 of the control module housing 10 can also be more clearly distinguished from the shape of the over-mold ends shown in FIG. 11. The right side of the control module housing over-mold has two lips that positively engage mating grooves in the control module housing substructure to assist in holding the over-mold to the control module housing substructure.

The illustrated example also has four openings 62 shown in the flared section 51 of the elongated vaginal member into which molded posts of the elongated clitoral members or attachment components can be inserted to affix the clitoral members to the bottom surface of the proximal end of the vaginal member. This allows the clitoral members to be separately molded and affixed to the elongated vaginal member which is integrally molded with the control module housing substructure.

Once the clitoral members are affixed to the elongated vaginal member to form a complete spine, the vibrations from the vibratory mechanisms affixed to the clitoral members can be communicated to the vaginal member, and the vibrations from the vibratory mechanism affixed to the vaginal member can be communicated to the clitoral members. The combination of operating each of the three vibratory mechanisms in different vibratory modes and communicating the different vibrations through the spine results in a pulsed effect produced by the constructive and destructive interference of the individual vibrations.

Figure 13:
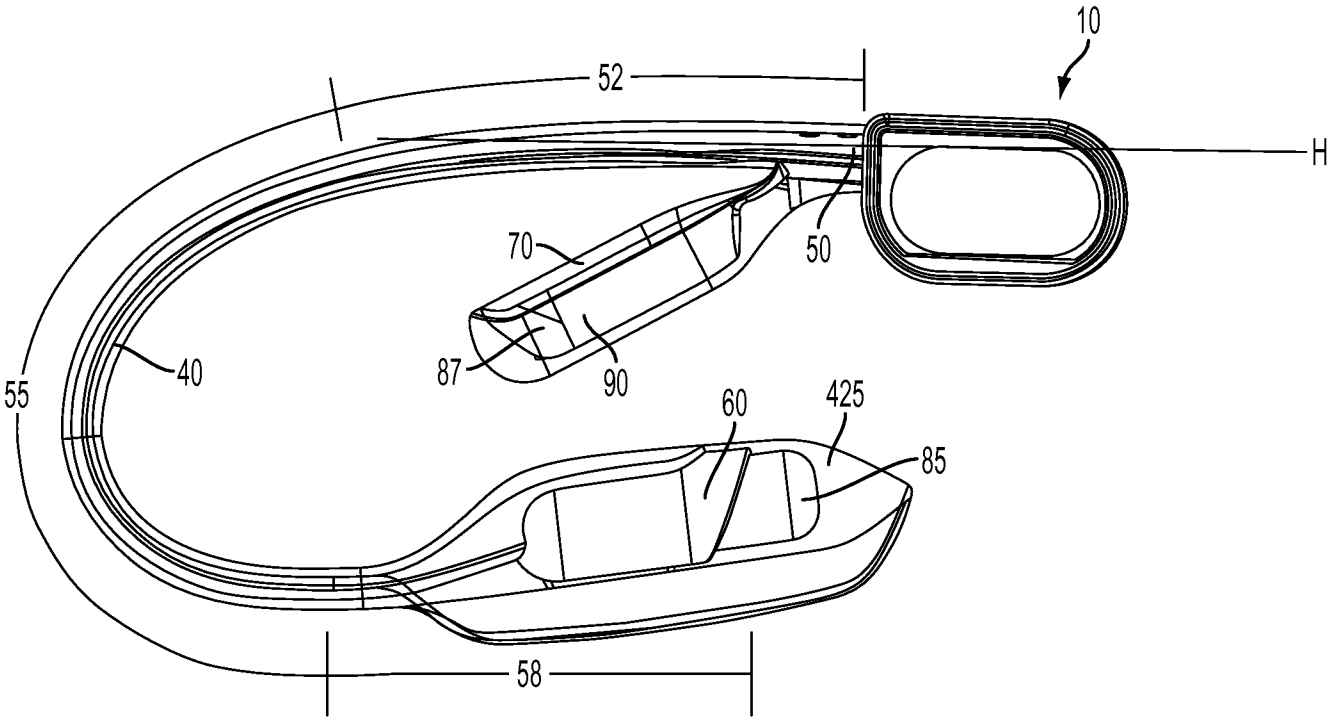
FIG. 13 is a line drawing of the right side view of an embodiment of the spine and over-mold showing the relationship between control module housing, vaginal member, and ears.

FIG. 13 is a line drawing of the right side view of an embodiment of the spine and over-mold showing the relationship between control module housing 10, vaginal member 40, and clitoral members 70. The elongated clitoral members 70 extend, preferably in a straight line, below the horizontal plane 'H' of the proximal end 50 of the elongated vaginal member 40, where the proximal end 50 is part of the upper section 52 of the approximately 'U' or 'C' shaped vaginal member 40, and the control module housing. The respective lengths of the elongated vaginal member 40 and the elongated clitoral members 70 result in the clitoral members 70 and clitoral member vibratory mechanisms 87 being located approximately directly above the distal end 60 and vaginal member vibratory mechanism 85, which coincides with the positions of the clitoris and G-spot when being properly worn. The clitoral vibratory mechanisms can be a different size or shape than the vaginal vibratory mechanism. The two clitoral members 70 are directed downwards towards the labia and clitoris, and straddle the clitoris when being properly worn by a female. The curved portion 55 of the elongated vaginal member 40 is configured and dimensioned to curve past the vulva to the vaginal opening, and provides at least a portion of a spring restoring force towards the upper portion of the vaginal member. The distal end 60 of the elongated vaginal member 40 and the shell shaped over-mold covering 425 are configured and dimensioned to be inserted into the vagina. The approximate locations of the upper portion 52, curved portion 55 and lower portion 58 of the elongated vaginal member 40 are depicted in FIG. 13. The distal ends of the clitoral 90 and vaginal 60 members are thereby directed towards each other, and simultaneously apply a pressure internally on the G-spot and externally on the clitoris, wherein the pressure applied to the clitoris can be less than the pressure applied to the G-spot and vaginal wall. The combination of shapes of the distal ends and over-mold, and applied pressure also serves to hold the apparatus in position during use.

Figure 14A:
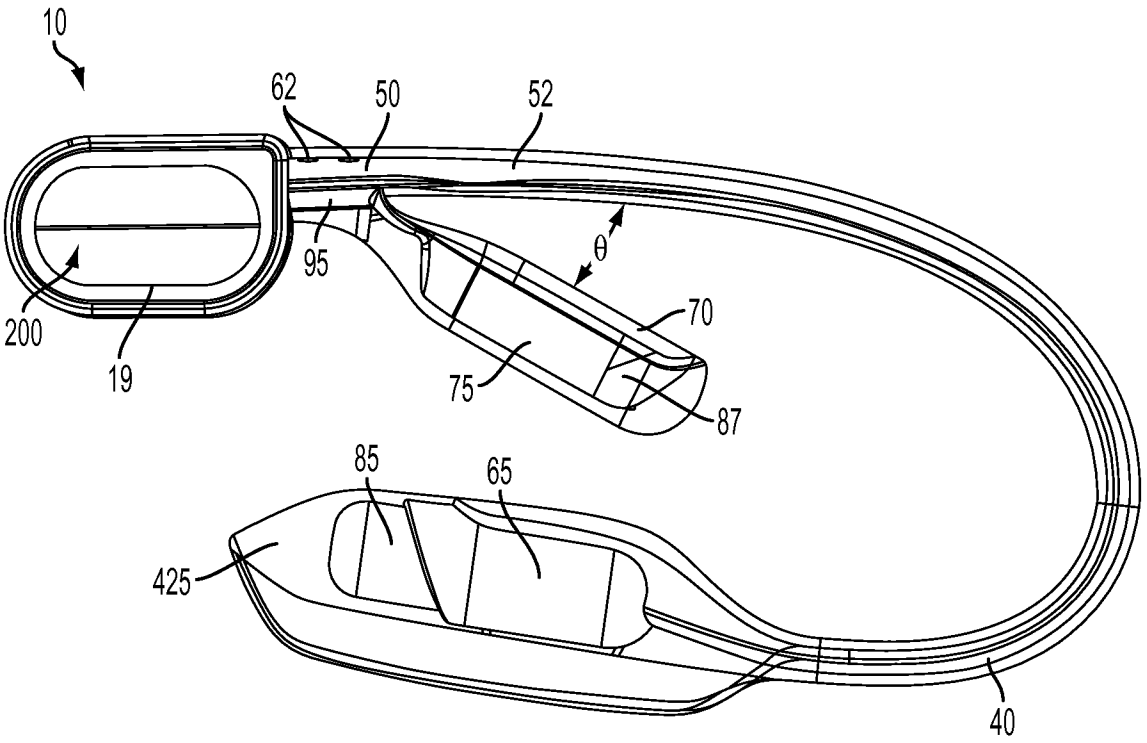
FIG. 14A is a line drawing of the left side view of an embodiment of the spine and over-mold showing a possible relationship between the positions of the control module housing, vaginal member, and ears.

FIG. 14A is a line drawing of the left side view of an embodiment of the spine and over-mold showing a possible relationship between control module housing 10, elongated vaginal member 40, and elongated clitoral members 70, as discussed above for FIG. 13. This particular embodiment has the distal end of the vaginal member positioned below the clitoral members, such that a clamping force is created so the distal end of the vaginal member presses against the G-spot and the clitoral members press against the clitoris. This arrangement does not allow the clitoral members to exert a different or lesser force against the clitoris than the force created by the vaginal member. A side of a control module 200 can be seen in the open area 19 of the control module housing 10. In the preferred embodiment, this opening is covered by a pliable over-mold that allows a used to see the control module 200 and be able to press against the pliable covering to push the control module out the opening in the opposite end of the control module housing.

FIG. 14A also shows a cylindrical housing 75 for the vibratory mechanism affixed to the elongated clitoral member 70, and a cylindrical housing 65 at the distal end of the elongated vaginal member 40 to which a vibratory mechanism is also affixed. The tortoise shell shape of the pliable over-mold material 425 covering the distal end of the vaginal member 40 is also discernable.

Figure 14B:
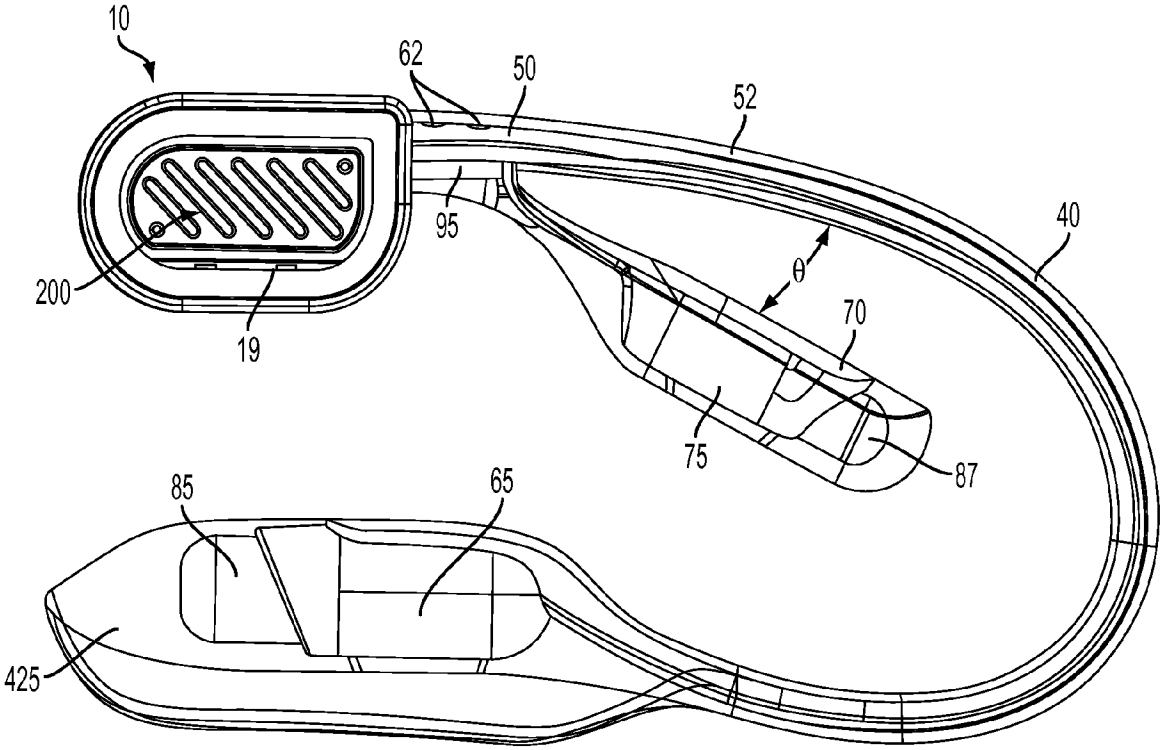
FIG. 14B is a line drawing of the left side view of a more preferred embodiment of the spine and over-mold showing an alternate relationship between the positions of the control module housing, vaginal member, and ears.

FIG. 14B is a line drawing of the left side view of a more preferred embodiment of the spine and over-mold showing an alternate relationship between control module housing 10, elongated vaginal member 40, and elongated clitoral members 70, compared to the configuration shown above in FIG. 14A. This more preferred embodiment has the distal end 60 of the vaginal member and vibratory mechanism 85 positioned below the control module housing, such that a clamping force is created so the distal end of the vaginal member presses against the G-spot and the control module housing 10 presses against the mons pubis. This more preferred arrangement allows the clitoral members 70 to exert a different lesser force against the clitoris than the force created by the vaginal member 40. A side of a control module 200 can be seen in the open area 19 of the control module housing 10. In the preferred embodiment, this opening is covered by a pliable over-mold that allows a user to see the control module 200 and be able to press against the control module end or pliable covering to push the control module out the opening at the opposite end of the control module housing.

In the illustrated example of this more preferred embodiment, the vaginal vibratory mechanism 85 can be seen to be positioned approximately below the control module housing 10. Flexing of the elongated vaginal member 40 away from the clitoral members creates a spring restoring force that applies pressure to both the G-spot and mons pubis when the device is properly inserted in the vagina, and allows a relatively independent application of force against the clitoris.

FIG. 14A also shows a cylindrical housing 75 for the vibratory mechanism affixed to the elongated clitoral member 70, and a cylindrical housing 65 at the distal end of the elongated vaginal member 40 to which a vibratory mechanism is also affixed. The tortoise shell shape of the pliable over-mold material 425 covering the distal end of the vaginal member 40 is also discernable. It can also be seen in FIG. 14 that the top side of the proximal end 95 of the clitoral members 70 are affixed to the underside of the proximal end 50 of the vaginal member 40 utilizing the openings 62, such that there is an acute angle 'θ' between the clitoral members 70 and the upper portion 52 of the vaginal member 40. The clitoral members 70 preferably extend in a straight line away from the connection with the vaginal member at the angle 'θ'. The elongated clitoral members can, therefore, independently flex towards and away from the elongated vaginal member such that the angle 'θ' for each clitoral member can increase and decrease, but the clitoral members do not flex laterally. The clitoral members 70 flex primarily at the thin section between the proximal portion attached to the vaginal member and the distal portion that forms the cylindrical housing 75 for the vibratory mechanism.

Figure 15:
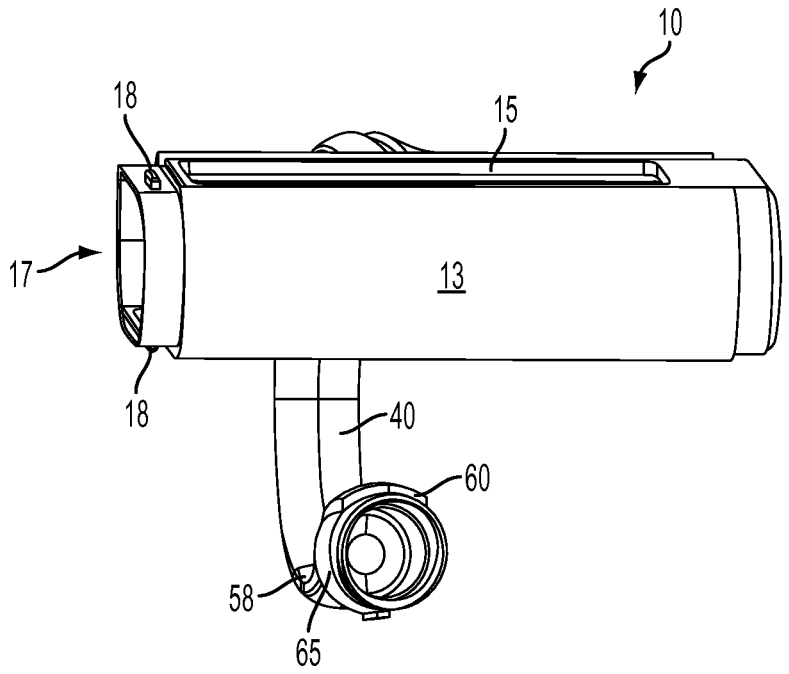
FIG. 15 is a line drawing of a front perspective view of an embodiment of the spine showing the control module housing with opening, and vaginal member forming a cylindrical housing for a vibratory mechanism.

FIG. 15 is a line drawing of a front perspective view of an embodiment of the spine and control module housing substructure showing the curved front face 13 of the control module housing 10 with a side opening 17 configured and dimensioned for a control module to be slidably inserted, a lip 18 for securing a cap, and a window opening 15. The lower portion 58 of elongated vaginal member 40 is shown expanding to form an integral cylindrical housing 65 for affixing a vibratory mechanism. The distal end 60 of the elongated vaginal member is below the proximal end 50 of the elongated vaginal member 40 and control module housing 10, which serves as the docking portion for this particular example of a preferred embodiment.

Figure 16:
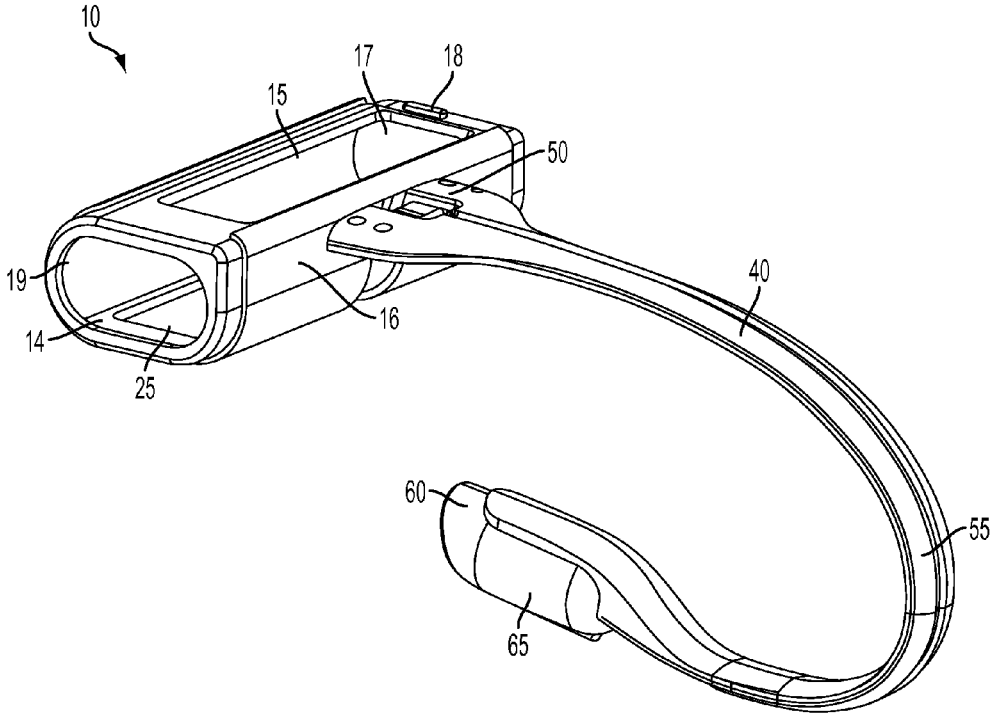
FIG. 16 is a line drawing of a bade perspective view of an embodiment of the spine showing the control module housing with openings, and vaginal member ending in a cylindrical housing for a vibratory mechanism.

FIG. 16 is a line drawing of a back perspective view of an embodiment of the spine and control module housing substructure showing the control module housing 10 with top opening 15 and side opening 19, as well as a bottom opening 25 in the bottom face 14 for receiving the control module housing PCB 20. The opening 25 allows the top surface of the control module housing PCB 20 to be flush with the interior surface of the control module housing bottom face 14, which avoids raised edges and lower any other surface features on the PCB that the control module may catch on when being inserted. The flush surfaces would also allow the leaf spring contacts on the control module housing PCB to be the only feature raised above interior surface of the bottom face 14 of the control module housing, and thereby to form a better electrical connection with the contacts on the bottom face of the control module PCB (not shown). The rounded and beveled edges and corners of the control module housing, as well as the polarized shape of the control module housing, which permits the control module to only be inserted with a specific orientation, are also discernable in FIG. 16.

The proximal end 50 of the elongated vaginal member 40 in this embodiment is integrally formed with the back face 16 of the control module housing as a single molded piece. FIG. 16 also illustrates vaginal member 40 ending in a cylindrical housing 65 configured and dimensioned for receiving a mating vibratory mechanism. The elongated vaginal member 40 in this illustrated example has a width that is greater than its thickness, which in combination with the stiffness of the spine material and shape of the curved portion 55 allows the proximal 50 and distal 60 ends of the vaginal member 40 to flex towards and away from each other, while preventing lateral deflections, which could result in a loss of vertical alignment between the proximal and distal ends, and loss of consistent contact with the clitoris and G-spot.

In another embodiment, the ears are not affixed to the elongated vaginal member 40, so only the G-spot would be stimulated by that particular example of the vibratory apparatus.

Figure 17A:
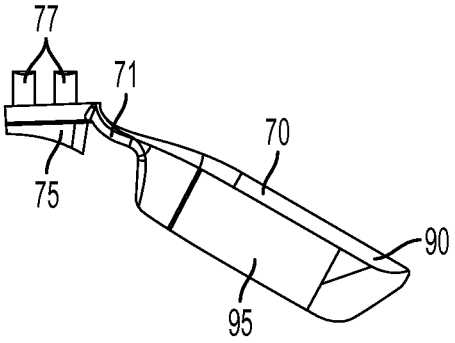
FIG. 17A is a line drawing showing a side view of an embodiment of the spine of the clitoral members.

FIG. 17A is a line drawing showing a side view of an example of an embodiment of the elongated clitoral members 70. The distal end 90 of the clitoral member expands to form a cylindrical housing 95 for affixing a vibratory mechanism 80. The proximal end 75 of the clitoral member 70 comprises a bridge portion 73 with one or more molded vertical posts 77 that are configured and dimensioned to be inserted into openings 62 in the flared section 51 of the proximal end 50 of the elongated vaginal member 40. The distal end 90 preferably extends away from the proximal end in a straight line, and forms an angle with the proximal end where the distal end joins the proximal end 75 and bridge portion 73. The proximal end 75 of the elongated clitoral member 70 is connected to the clitoral cylindrical housing 95 and distal end 90 by a thinner, more flexible connecting portion 71. In other embodiments, the elongated clitoral members 70 (or ears) can be two separate members with each having one or more posts for connection to the elongated vaginal member, but without the bridge portion 73 joining the clitoral members.

Figure 17B:
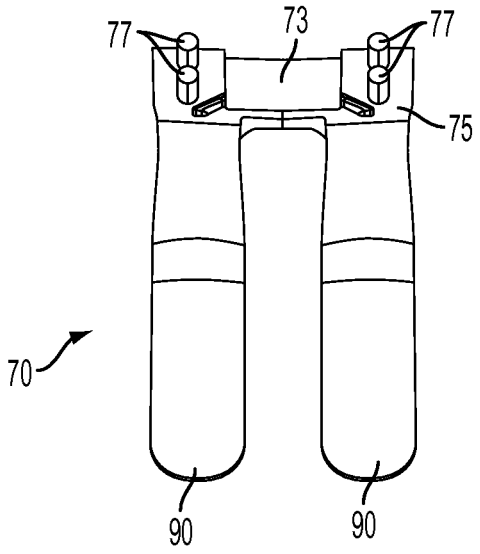
FIG. 17B is a line drawing showing a top perspective view of an embodiment of the spine of the clitoral members.

FIG. 17B is a line drawing showing atop perspective view of the same example of an embodiment of the elongated clitoral members 70, as shown in FIG. 17A, having a bridge portion 73 at the proximal end 75 that connects the two separate distal ends 90. Four posts 77 for affixing the clitoral members 70 to the vaginal member 40 are also illustrated in FIG. 17B. It can be seen from FIGS. 17A and 17B that the portion 71 connecting the distal ends 90 of the clitoral members to the proximal end 75 and bridge portion 73 are wider than they are thick to allow the clitoral members to flex towards and away from the upper portion of the of the elongated vaginal member.

Figure 18A:
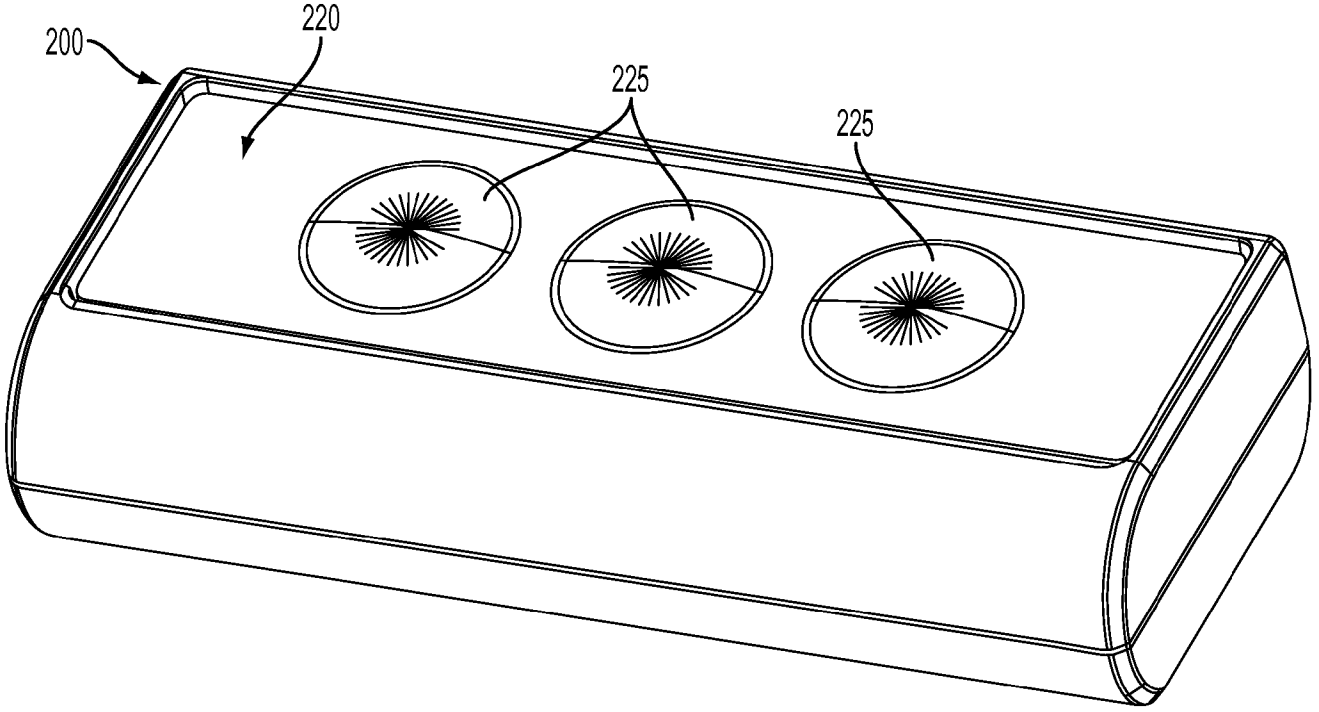
FIG. 18A is a line drawing showing a perspective view of an embodiment of the control module with buttons.

FIG. 18A is a line drawing showing a perspective view of an embodiment of the control module 200 with a rechargeable battery pack and three buttons for the user interface showing in the window of the control module body. The rechargeable control module can be inserted into a battery charger (see FIG. 20B).

Figure 18B:
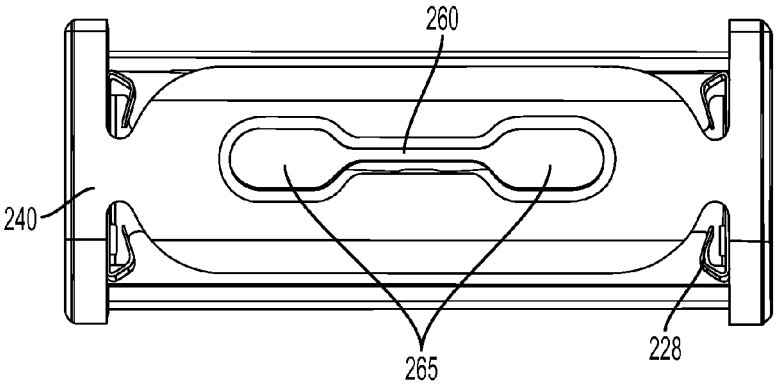
FIG. 18B is a line drawing showing a perspective view of an example of another embodiment of the control module with an toggle mechanism.

FIG. 18B is a line drawing showing a perspective view of an embodiment of the control module having a housing 240 and toggle mechanism 260 having toggle pads 265 on opposite sides of a fulcrum that operates an on-off switch (not shown).

Figure 18C:
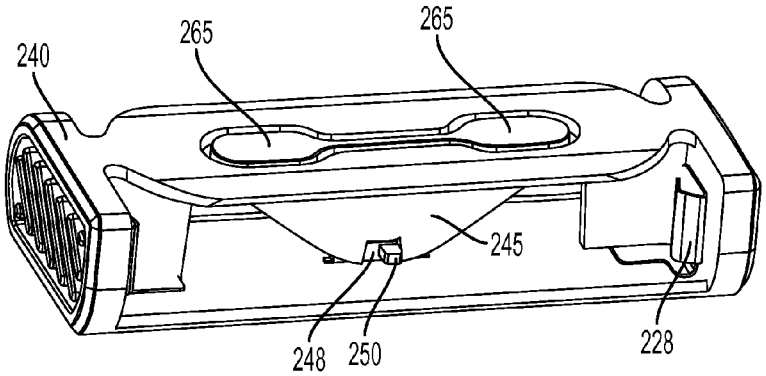
FIG. 18C is a line drawing showing a perspective view of FIG. 18B showing an on-off switch activated by the toggle mechanism.

FIG. 18C is a line drawing showing a perspective view of an embodiment of the control module showing an on-off switch and the toggle mechanism 260. The notch 248 in the fin 245 engages the switch member 250 so that it can push the switch member 250 from a first position to a second position when the toggle pads 265 on the control module body are depressed. Power contacts 228 for making electrical contact with the batteries (not shown) are affixed to the housing 240 or a PCB.

Figure 19A:
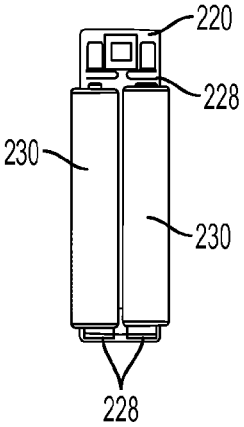
FIG. 19A is a line drawing showing a top view of the batteries, PCB and contacts of an example of a control module.

FIG. 19A is a line drawing showing a top view of the batteries 230, PCB 220 and power contacts 228 for another embodiment of a battery pack type control module. The two 'AAAA' batteries of this particular example are shown inserted between the power contacts of the PCB 228. The power source comprising the two 'AAAA' batteries would be electrically connected to the vibratory device through electrical contacts (not shown) on the bottom face of the battery pack.

Figure 19B:
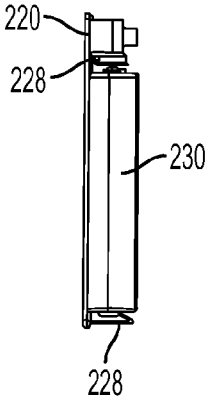
FIG. 19B is a line drawing showing a side view of the batteries, PCB and contacts of an example of a control module.

FIG. 19B is a line drawing showing a side view of the batteries 230, PCB 220 and power contacts 228 of the control module 200 illustrated in FIG. 19A.

Figure 19C:
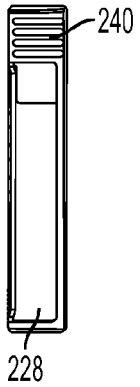
FIG. 19C is a line drawing showing a side view of an example of a Control Module Body, PCB and contacts.

FIG. 19C is a line drawing showing a side view of an example of molded body 240 that retains the control module PCB 220 and batteries 230. The exterior side of the bottom face of the control module 14 would expose the bottom face of the control module PCB 220 having a predetermined arrangement of contacts 222 (not shown), wherein the contact would preferably be conductive metal contacts in the form of either deposited pads, surface mounted contact plates, or leaf springs.

Figure 20A:
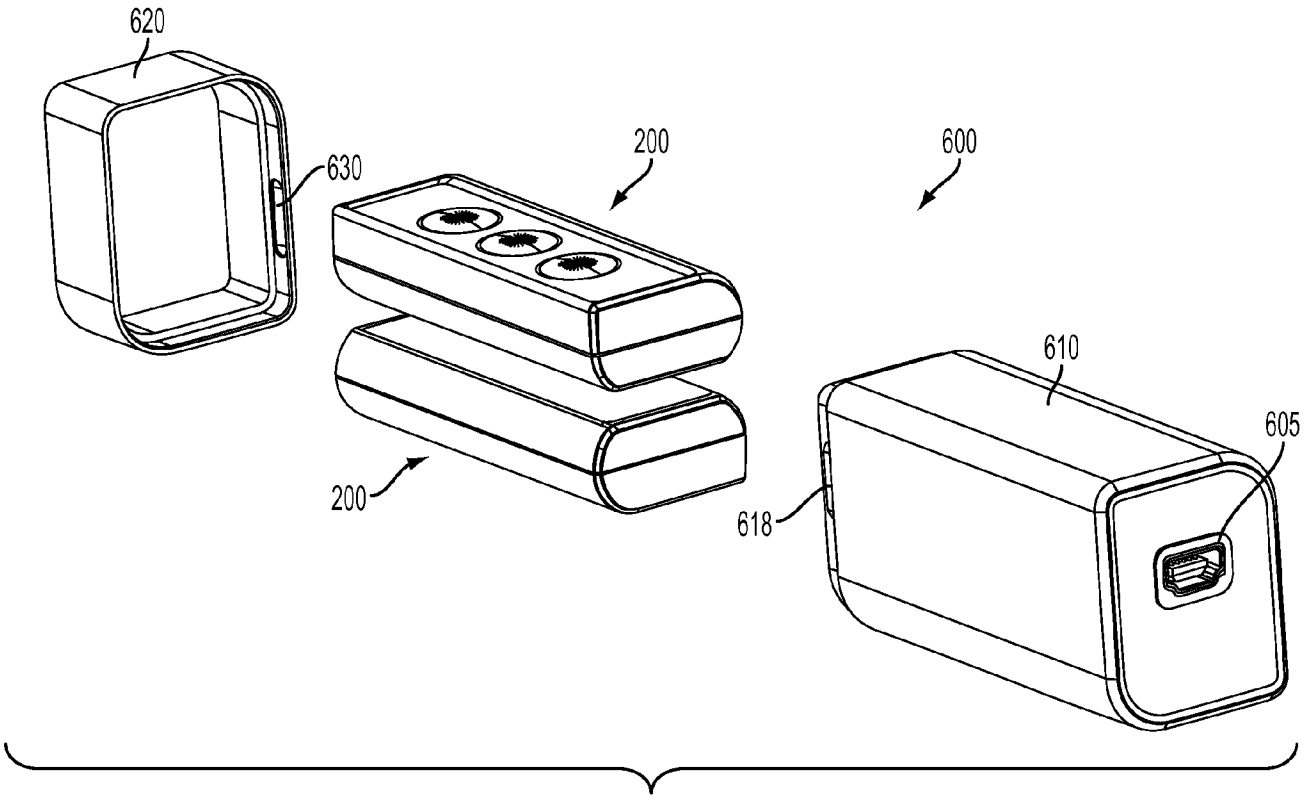
FIG. 20A is a line drawing showing an exploded perspective view of preferred embodiment of a battery recharger having a cap and an electrical connection.
Figure 20B:
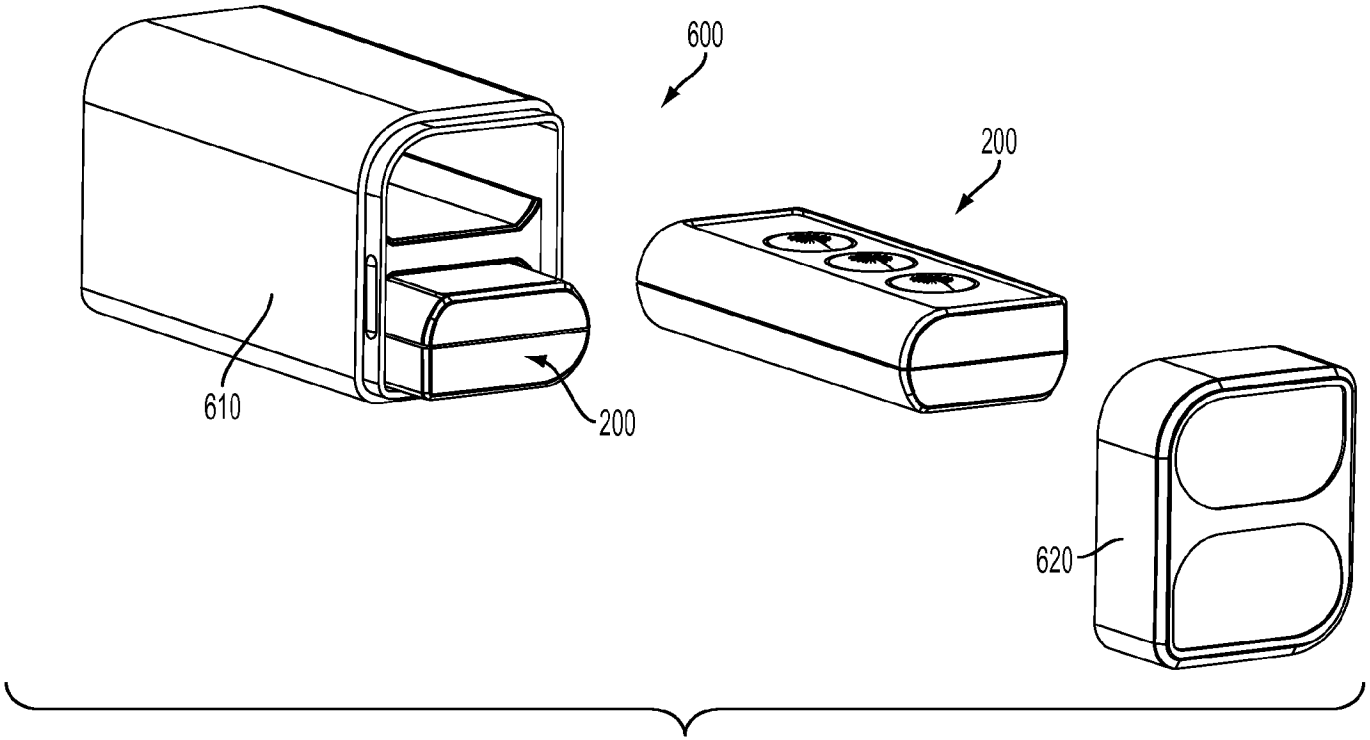
FIG. 20B is a line drawing showing an exploded perspective view of an example of a battery recharger designed to contain two rechargeable control modules.

FIG. 20A is a line drawing showing a perspective view of an embodiment of a rechargeable battery recharger 600 having a recharger body 610, lips 618 for securing a resilient cap, and a cap 620 with catches 630 for securing the cap to the recharger body. FIG. 20A also shows a USB type plug for connecting the recharger to a portable computer or other such device for receiving power. FIG. 20B is a line drawing showing a perspective view of an embodiment of a rechargeable battery recharger 600 for use with a rechargeable type of control module. In an example of a preferred embodiment illustrated in FIG. 20B, two rechargeable type control modules 200 can be contained in the recharger and recharged simultaneously. The recharger could be adapted to plug into a standard wall outlet or connected with a USB type plug to a computer or similarly configured electrical adapter, although other electrical connections, such as a standard wall plug or other plug or jack for connection to a transformer type power supply are also contemplated within the scope of the invention (not shown). Rechargers of different sizes and having more or less capacity are also contemplated within the principles and scope of the present invention. Various sizes of recharger 600 could also be included with a kit comprising at least one control module 200 and at least one vibratory device 100 that can be assembled, so that the control module is operatively associated with the vibratory device to form an operational vibratory apparatus 1.

Figure 21:
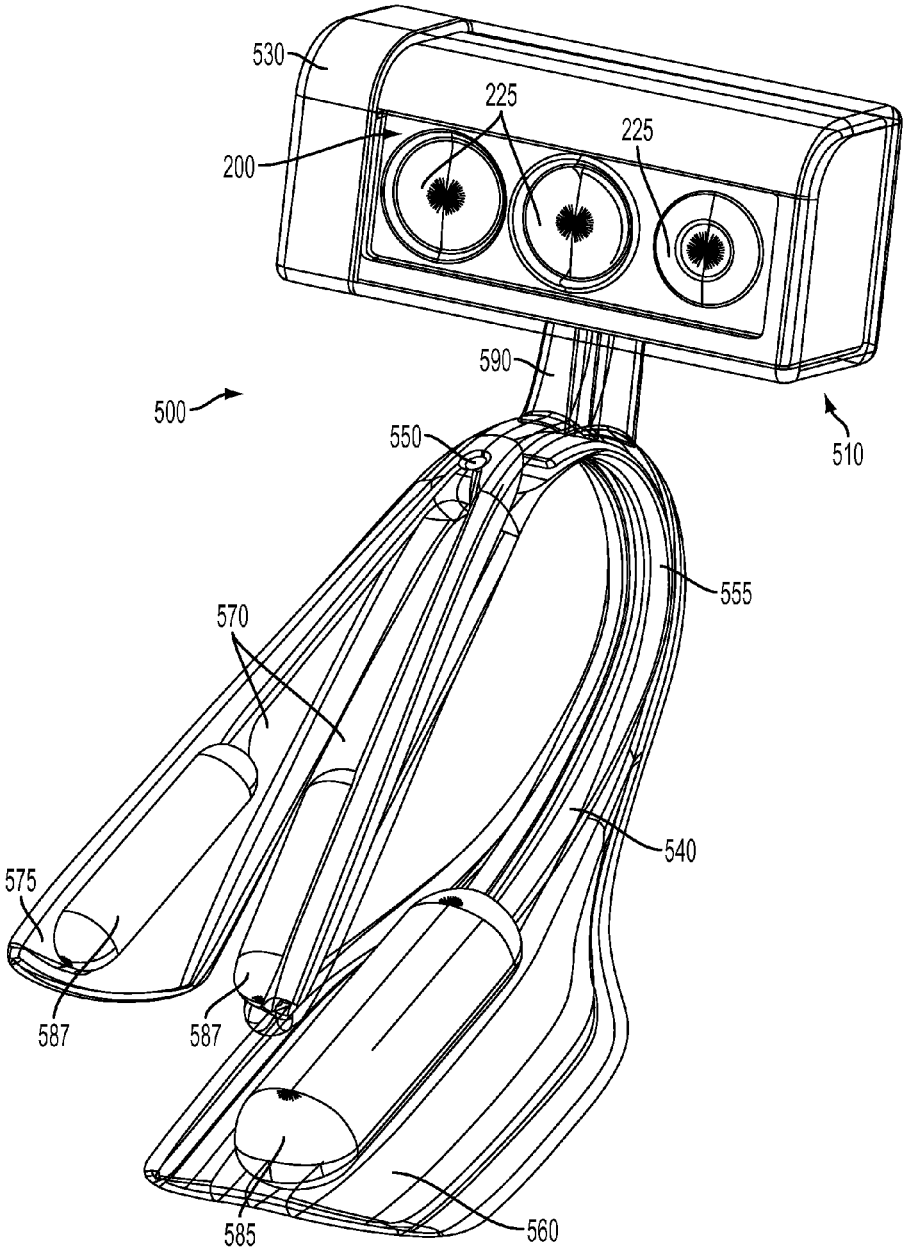
FIG. 21 is a perspective line drawing of an embodiment of the assembled vibratory apparatus having a second body structure.

FIG. 21 is a perspective line drawing of an embodiment of the assembled vibratory apparatus 500 having a second body structure, wherein the spine of the particular illustrated example comprises a 'Y' shaped structure having a curved longer vaginal leg 540 and two shorter clitoral arms 570 joined together at a branching point 550. The spine can further comprise an extension section 590 extending from the curved portion 555 of the longer vaginal leg 540. A docking portion can join to the end of the extension portion 590 opposite the connection to the vaginal leg 540. In the illustrated example, the docking portion is a control module housing 510 configured and dimensioned to receive a mating control module. A cap 530 can positively retain the control module 200 in the control module housing 510, such that the control module 200 can only be oriented so the control module buttons 225 are accessible to a user. The extension portion 590 preferably extends away from the curved portion of the longer vaginal leg in the same plane as the curvature of the vaginal leg. The docking portion preferably lies perpendicular to the plane of the curvature of the vaginal leg 540.

A clitoral vibratory mechanism 587 is preferably affixed to the distal end 575 of each of the two clitoral arms 570, and a vaginal vibratory mechanism 585 can be affixed to the distal 560 of the longer vaginal leg 540. The vibratory mechanisms are electrically connected to the control module 200 by electrical paths along the length of each arm and leg (not shown).

The principles of the present invention also relate to a kit comprising a vibratory device designed to stimulate both the G-spot and the clitoris of the female genitals simultaneously, and an easily removable control module operatively associated with the vibratory device. The control module(s) and vibratory device(s) are adapted to have a combination of contact points that are configured to be connected by a user who purchases the kit.

Figure 22:
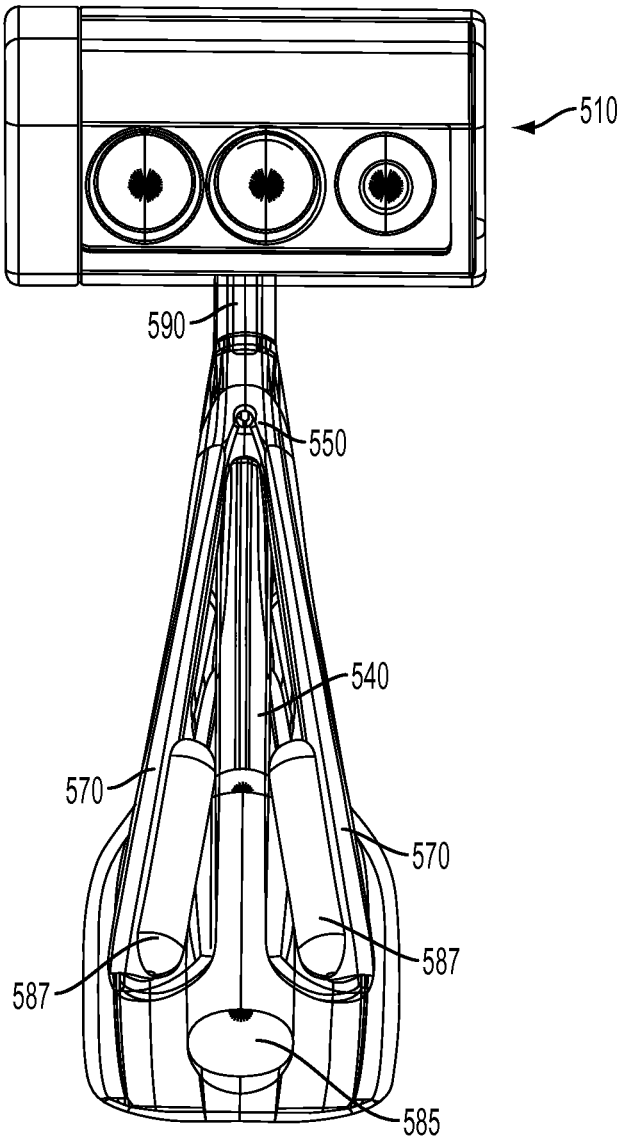
FIG. 22 is a perspective line drawing of the top view of an embodiment of the invention.

FIG. 22 is a perspective line drawing of the top view of an embodiment of the invention having the second body structure. The two clitoral arms 570 are shown extending away from the branching point 550 forming an acute angle between the two arms. The longer vaginal leg 540 is positioned below and between the two clitoral arms 570, such that the vaginal vibratory mechanism 585 is approximately below the clitoral vibratory mechanisms 587.

An over-mold covers both clitoral arms 570 and the vaginal leg 540 of the spine, and can also cover the extension section 590 and control module housing 510.

Figure 23:
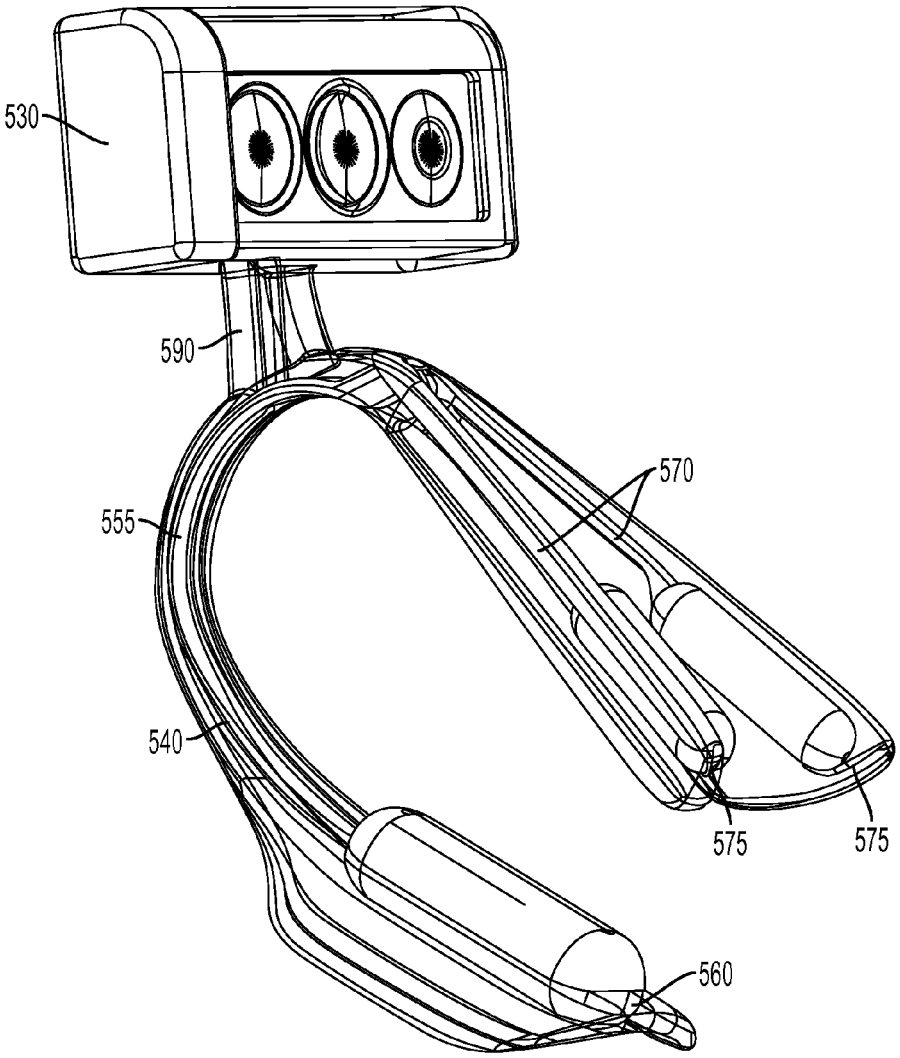
FIG. 23 is a perspective line drawing of a side view of an embodiment of the invention.

FIG. 23 is a perspective line drawing of a side view of an embodiment of the invention. The curvature of the curved portion 555 of the longer vaginal leg 540 positions the distal end 560 of the vaginal leg 540 below the distal ends 575 of the two clitoral arms 570. The arrangement of the two clitoral arms 570 and longer vaginal leg 540 forms a curved, 'Y' shaped spine that places the clitoral arms on either side of the clitoris and the vaginal leg within the vagina and preferably against the G-spot when being properly worn by a female.

Figure 24:
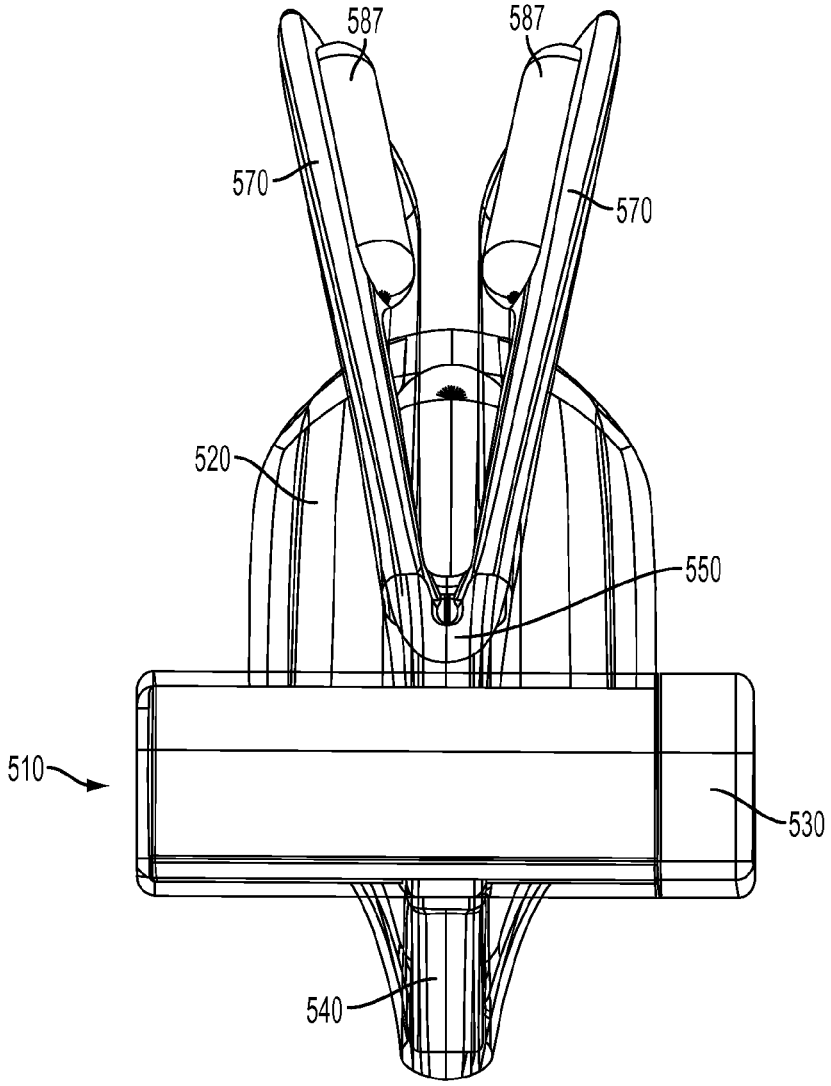
FIG. 24 is a line drawing of the top view of an embodiment of the invention.

FIG. 24 is a line drawing of the top view of an embodiment of the invention, which more clearly shows the branching point 550 and acute angle between the two clitoral arms 570, as well as the positioning of the clitoral vibratory mechanisms 587.

The over-mold covering 520 expands out from the vaginal leg 540 of the device to form a shell shape that contacts the vaginal wall when inserted in a vagina.

Figure 25:
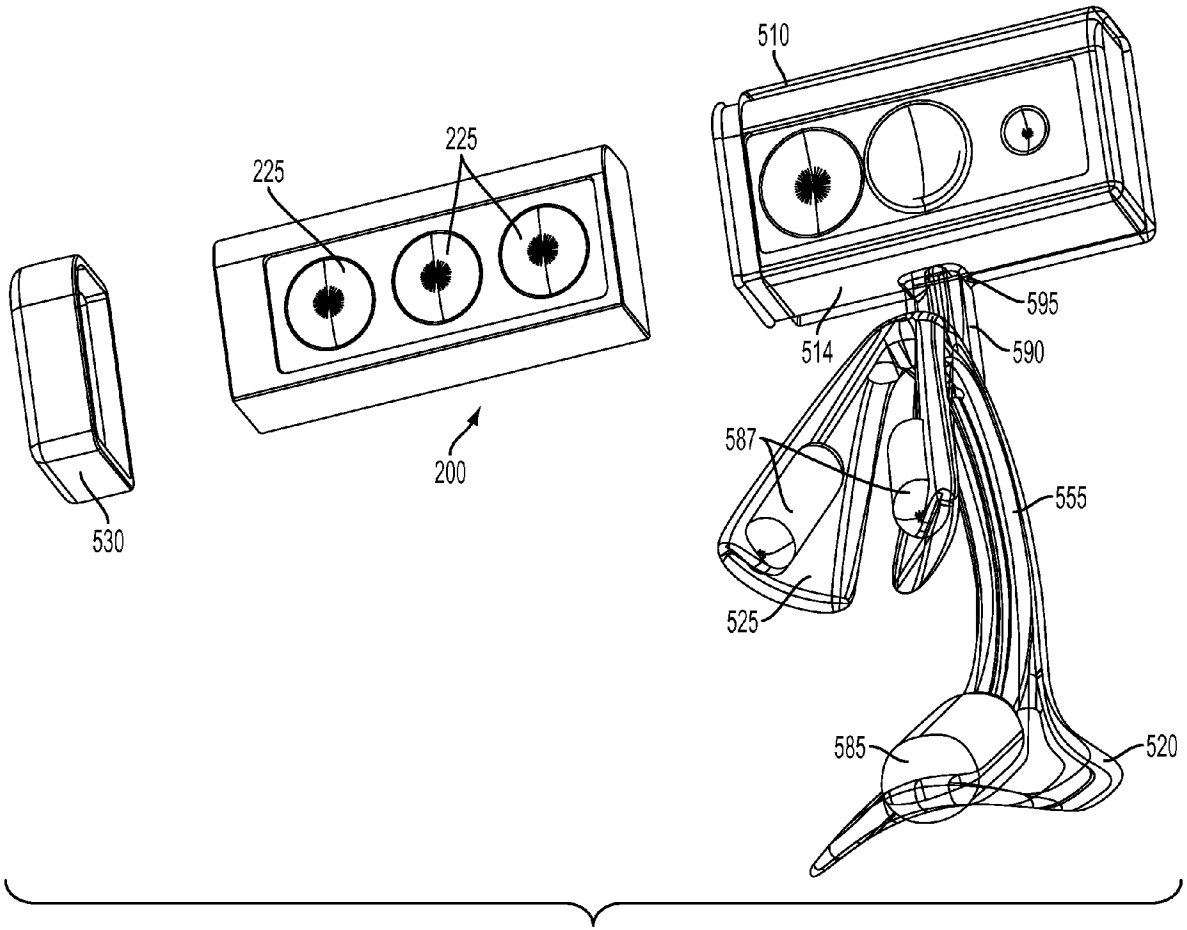
FIG. 25 is an exploded line drawing of a perspective view from the front of an embodiment of the invention.

FIG. 25 is an exploded line drawing of a perspective view from the front of an embodiment of the invention. The shell shaped over-mold 520 covering the distal end of the longer vaginal leg has a concave lower surface that allows sufficient space for the insertion of a penis or penis-shaped object when the vibratory device is inserted in a vagina. The distal ends of the clitoral arms have a triangular shaped over-mold covering 525 that makes contact with the clitoris and labia when properly worn. The docking portion end 595 of the extension section joins to the bottom face 514 of the control module housing 510. The 'Y' shaped spine, including the extension section, can be injection molded as a single piece along with the control module housing 510. The control module 200 is configured and dimensioned to be slidably insertable into an end of the control module housing 510, in such a manner that the buttons of the user interface can only be oriented towards the front of the control module housing. The pliable cap 530 positively retains the control module 200 within the control module housing by being affixed on the open end of the control module housing. The curved portion 555 of the vaginal leg in this illustrated example has a width that is greater than its thickness, which in combination with the stiffness of the spine material and shape of the curvature allows the vaginal vibratory mechanism to flex towards and away from the clitoral vibratory mechanisms 587, while preventing lateral deflections, which could result in a loss of vertical alignment between the distal ends of the clitoral arms and vaginal leg, as well as loss of consistent contact with the clitoris and G-spot.

The respective lengths of the longer vaginal leg 540 and the clitoral arms 570 result in the clitoral arms 570 and clitoral vibratory mechanisms 587 being located approximately directly above the distal end 560 and vaginal vibratory mechanism 585, which coincides with the positions of the clitoris and G-spot when being properly worn. The clitoral vibratory mechanisms can be a different size or shape than the vaginal vibratory mechanism.

FIG. 26 shows the more preferred embodiment illustrated in FIGS. 3B and 14B being properly worn so that the control module housing is pressing against the mons pubis and the distal end of the vaginal elongated member is pressing against the G-spot, while the clitoral members apply a separate different force against the clitoris.

Figure 27:
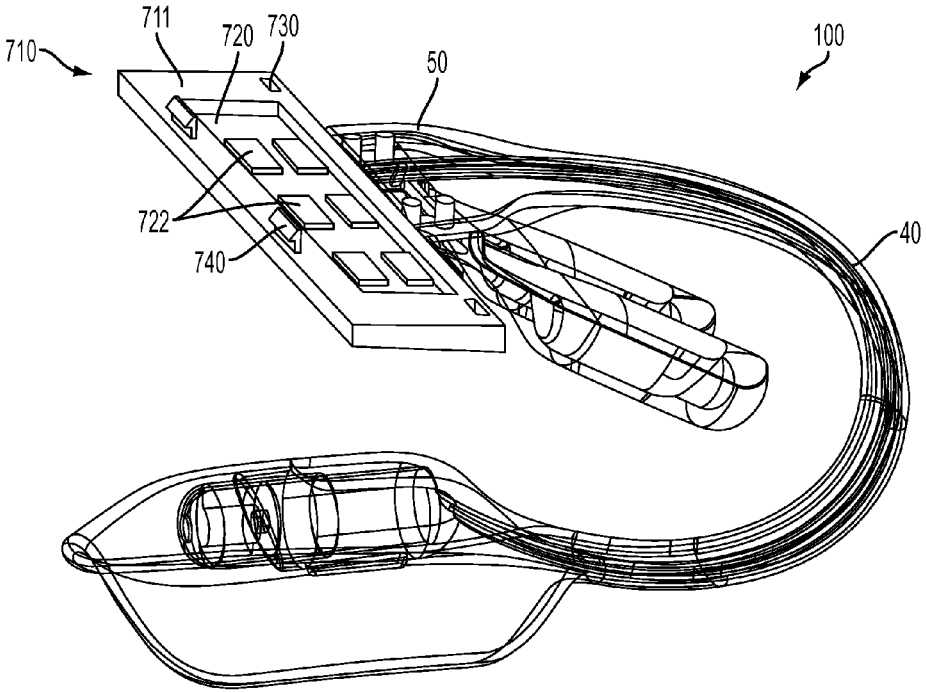
FIG. 27 is a line drawing of a perspective view of an embodiment having an example of a docking plate parallel to the spine.

FIG. 27 is an example of an embodiment of an assembled vibratory apparatus 1 showing the vibratory device 100 comprising a control module docking plate 710 for connecting a control module, a spine comprising a 'U'-shaped vaginal member 40 and two clitoral members 70, also referred to as ears, connected to a longer edge of the docking plate 710, such that the docking plate and proximal end 50 of the elongated vaginal member are in the same plane. The docking plate is preferably an approximately rectangular shaped plate comprising two faces, wherein at least one face is configured and dimensioned to have a width and length approximately equal to a mating face of a control module, and a thickness that is approximately equal to the combined thickness of the proximal end 50 of the elongated vaginal member and the proximal end of the attached clitoral members.

The docking plate preferably comprises electrical contacts 722 affixed directly to a top face 711 of the plate 710 or affixed to a PCB 720 that is affixed to the plate 710. The docking plate may further comprise features for mechanically connecting a control module to the docking plate. The docking plate connecting feature may be one or more notches 730 and/or one or more tab(s) 740 configured and dimension to be inserted into matching notches in a mating control module (not shown). The tabs and notches are preferably arranged on the docking plate in a polarized pattern that allows a control module to be connected in only one orientation. Other mechanical connecting features known to those of ordinary skill in the molding and forming arts are also contemplated within the scope of the invention.

Figure 28:
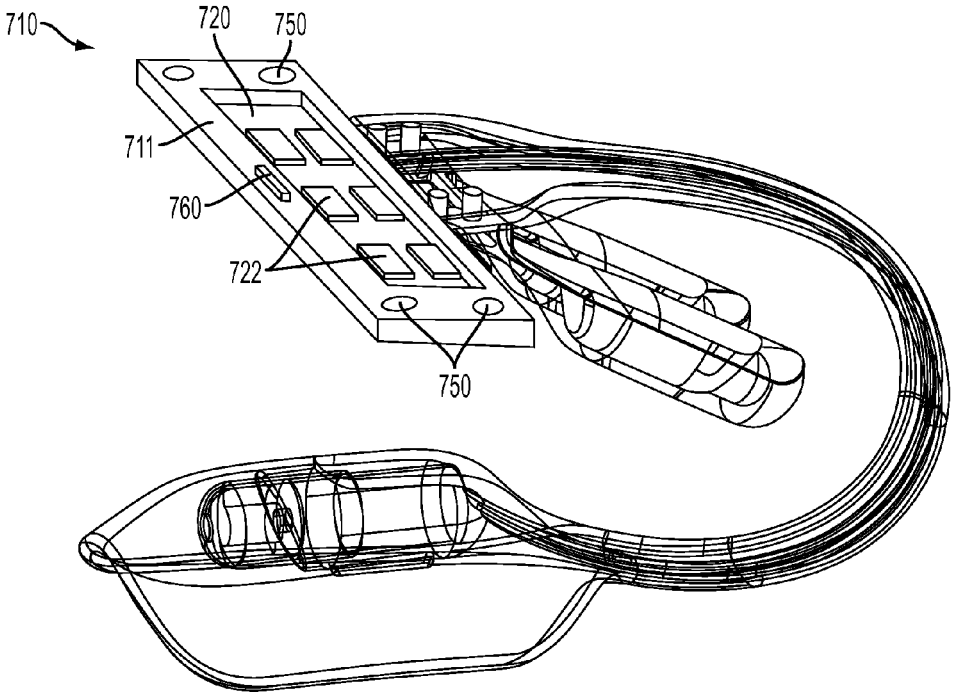
FIG. 28 is a line drawing of a perspective view of an embodiment having another example of a docking plate parallel to the spine.

A control module may also be connected to a docking plate 710 using one or more magnet(s) 750 located on either the docking plate (as shown in FIG. 28) or the control module, or magnets could be located on both the control module and docking plate and the polarities of the magnets arranged so the attractive and repulsive forces of the magnets only allow the control module to be connected to the docking plate in one orientation. Features to which a magnet would be attracted could be placed in matching locations on a face opposite a magnet to provide a surface to which a magnet would be attracted. A raised ridge 760 on either the control module or docking plate 710 and a matching notch on the opposite surface (not shown) could also be provided to prevent the magnets from getting close enough to create a connection if the control module and docking plate are not properly oriented and positioned.

A combination of magnetic and mechanical connecting features is also contemplated within the scope of the invention.

Figure 29:
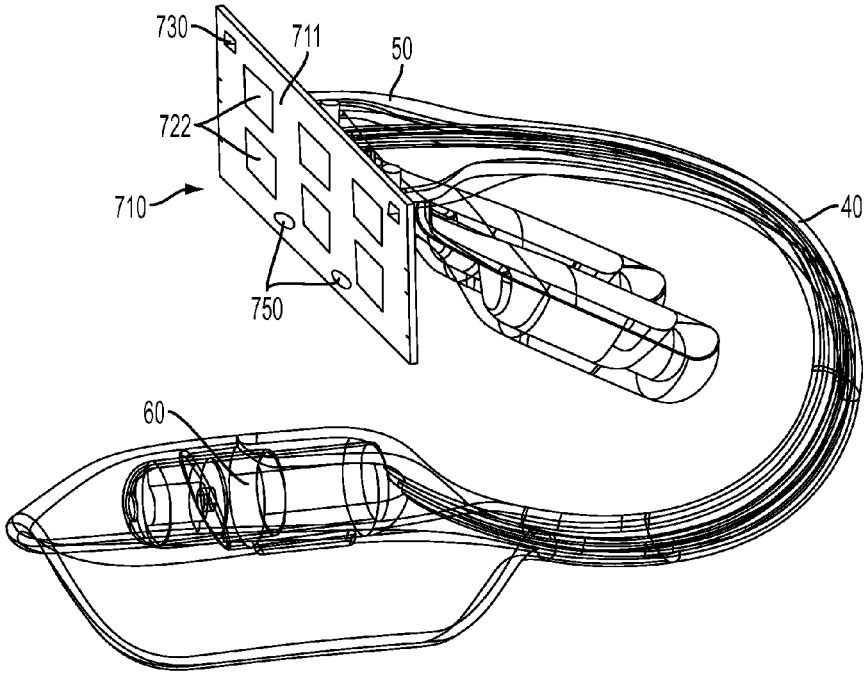
FIG. 29 is a line drawing of a perspective view of an embodiment having an example of a docking plate perpendicular to the spine.

FIG. 29 shows an example of an embodiment of a vibratory device having a docking plate positioned perpendicular to the flared proximal end 50 of the elongated vaginal member and clitoral members, wherein the electrical contacts 722 are printed directly on a face 711 of the docking plate 710, and notches 730 and magnets 750 are used to mechanically connect a control module to the docking plate 710. The control module could connect to the docking plate in a manner that a user interface on the control module faced directly away from the docking plate, or the user interface may face in a direction perpendicular to the face of the docking portion. The user interface preferably faces away from the distal end 60 of the elongated vaginal member 40, so as to be accessible to a user or partner while being properly worn.

All docking plates, control module housings, and control modules preferably have the same arrangement of connecting features and electrical contacts to allow physically interchanging any control module with any vibrator device having a docking plate or a control module housing. All docking plates, control module housings, and control modules preferably have the same arrangement of electrical contacts to allow electrical compatibility between any control module and any vibrator device. The docking plate forms an interface with a control module, and a closed electrical circuit between the vibratory mechanisms and the control module when they are mechanically connected.

The principles of the present invention further relate to a non-transitory computer readable storage medium having computer-readable instructions executable by a computer processing system stored thereon. The computer-readable instructions comprising; instructions that cause control electronics to produce a driving current having a particular wave form and frequency for communication to separate vibratory mechanisms; instructions that cause control electronics to increase or decrease the current communicated to each of the separate vibratory mechanisms; and instructions to determine if the computer processing system is operatively associated with a vibratory device. The computer readable instructions cause a computer processor to perform the steps of providing power from a power source to the one or more vibratory mechanisms in conductive communication with the power source, wherein the instructions adjust the pulse width modulation used to drive the vibratory mechanisms. The computer readable instructions may further cause a computer processor to put a control module into a locked mode, such that the vibratory apparatus will not turn on even while the control module is attached to the vibratory device, and/or to cycle through the intensity levels produced by the one or more vibratory mechanisms, or create a pulsed or harmonic effects by adjusting the intensity or waveform driving each of the vibratory mechanisms independently. The waveforms, frequencies, and intensity levels can be predetermined by the specific instructions stored in the non-transitory computer readable medium or the electrical components of the control module.

The principles of the present invention also relate to a method of stimulating a female's erogenous zones, and in particular the clitoris and G-spot. The method comprises providing a modular stimulation system as described above, and assembling the modules of the stimulation system so that a control module is operationally associated with a vibratory device to form an operational vibratory apparatus. The method can further comprise inserting the apparatus into the vagina, and adjusting the positioning of each of the elongated members such that a pleasurable amount of pressure is applied to the clitoris and an anterior side of a vaginal wall including the G-spot, when the elongated vaginal member is inserted into a vagina. The vibratory apparatus can begin to vibrate once the control module is operationally associated with the vibratory device, or a user command can be input into the user interface of the control module to turn on the vibratory apparatus. The method could also further comprise synchronizing a separate control module with the operatively associated control module to establish a communication link between the two control modules over a wireless connection, so the separate remote control module could be used to select from the various vibratory modes of the vibratory apparatus, or to broadcast control signals based on different vibratory modes stored in the separate control module, or based on input from motion sensors, position sensors, microphones, or other sensors. The user can utilize either the operatively associated control module or the separate remote control module in communication with the associated control module for selecting an operating mode using the user interface of the operatively associated control module. The method could also further comprise swapping a different control module with the operatively associated control module to change the overall functionality of the vibratory apparatus.

The method could also further comprise performing intercourse, wherein a male partner inserts his penis into the vagina in addition to the first elongated member of the vibratory apparatus so that both the male and female member experience stimulation from the vibrations of the vaginal vibratory mechanism. Either partner could also insert a penis shaped object or similar implement into the wearer's vagina, rather than engaging in intercourse.

While many of the embodiments describe a separate or removable control module, the vibratory apparatus can also be implemented with an integrated controller (i.e., a control module that is irremovable from a vibratory apparatus) by making the mechanical and/or electrical connections semi-permanent, or with control electronics and/or power sources that are hard wired to the vibratory apparatus, thus lacking any modularity. Such irremovable and non-modular implementations of the various embodiments are also contemplated within the spirit and scope of the present invention. The description illustrates various embodiments of a highly innovative new type of massager which has many features that are innovative on their own or in combination and are applicable to a wide range of different implementations or embodiments.

Examples of different particular embodiments of each of the various components as well as different embodiments of the overall apparatus have been illustrated and described above. The examples illustrate particular combinations of control module and vibratory device design features, however other combinations and arrangements of the various inventive features can be implemented, and are intended to be encompassed within the spirit and scope of the present invention. Furthermore, variations and modifications other than those illustrated and described will be apparent to persons of ordinary skill in the art. It is intended that all such embodiments, examples, variations, combinations, and modifications thereon are meant to be encompassed within the spirit and scope of the present invention as set forth in the following claims.

What is claimed is:

1. A vibratory apparatus comprising:

a vibratory device having a body structure comprising:

a docking portion, wherein the docking portion is configured and dimensioned to receive a control module; and a support member, wherein the member comprises a plurality of elongated members extending from the docking portion, wherein each of the plurality of elongated members has a distal end to which a vibratory mechanism is affixed; and a control module operatively associated with the vibratory device wherein the control module is removable from the vibratory device.

2. The vibratory apparatus of claim 1, wherein the docking portion comprises a substructure, and one or more electrical contacts associated with the substructure for forming an electrical connection between the control module and the one or more vibratory mechanisms; and the support member comprises at least one surface that provides an operative portion for massaging application to a part of a human body.

3. The vibratory apparatus of claim 1, wherein the docking portion is a control module housing; and the support member comprises:

a first elongated member having a 'U' shape with a first proximal end connected to the control module housing and a first distal end curved below the proximal end, wherein a first vibratory mechanism is affixed to the first distal end;

a second elongated member shorter than the first elongated member, the second elongated member having a second proximal end connected to the first proximal end of the first elongated member at the connection to the control module housing, and a second distal end angled downward from the first proximal end, wherein a second vibratory mechanism is affixed to the second distal end; and a third elongated member shorter than the first elongated member having a third proximal end connected to the first proximal end of the first elongated member at the connection to the control module housing, and a third distal end angled downward from the first proximal end, wherein a third vibratory mechanism is affixed to the third distal end.

4. The vibratory apparatus of claim 3, wherein the elongated members are made of a resilient, elastically deformable material.

5. The vibratory apparatus of claim 1, wherein the plurality of elongated members comprise at least a first elongated member, a second elongated member, and a third elongated member, the first elongated member is configured and dimensioned for insertion into a vagina, so as to provide an unobstructed entry and sufficient remaining space for insertion of a penis or penis shaped object into the vagina, and fitting comfortably between a vulva and against a vaginal wall; and the second and third elongated members configured and dimensioned to position a second and third vibratory mechanisms located at the distal end of each of the second and third elongated members against either side of a clitoris and against a labia.

6. The vibratory apparatus of claim 1, wherein the control module comprises:

a user interface for selecting an operating mode from a plurality of options;

electronic circuitry suitable for independently controlling the operation of a plurality of individual vibratory mechanisms, the electronic circuitry comprising a processor for reading a non-transitory computer readable medium and providing electrical signals and power to the one or more of the individual vibratory mechanisms, the processor coupled to the non-transitory computer readable medium for storing instructions that provide various separate operating modes for the individual vibratory mechanisms; and a power source; and electrical contacts for communicating the electrical signals and power to the plurality of individual vibratory mechanisms.

7. The vibratory apparatus of claim 6, wherein the separate operating modes provide for operating the individual vibratory mechanisms at one or more different individual vibratory frequencies to produce a harmonic pulsating effect, varying the vibratory frequency and intensity of each individual vibratory mechanism over time during operation to produce a pulsed effect, or both.

8. A vibratory device comprising:

a docking portion configured and dimensioned to releasably engage a control module;

a plurality of electrical contacts positioned on a face of the docking portion, wherein the electrical contacts are arranged in a predetermined pattern that corresponds to an arrangement of electrical contacts on a mating face of the control module;

a plurality of spines extending from the docking portion; and at least one vibratory mechanism affixed to each spine and in electrical communication with the electrical contacts.

9. The vibratory device of claim 8, wherein the vibratory device is removable from a mating control module with which the vibratory device is engaged.

10. The vibratory device of claim 8, wherein the docking portion further comprises a printed circuit board affixed to the face of the docking portion, and the plurality of electrical contacts are mounted on the printed circuit board.

11. The vibratory device of claim 8, wherein the spine comprises at least a first elongated member having a 'U' shape with a first proximal end connected to the docking portion and a distal end curved below the first proximal end, and the vibratory mechanism affixed to the distal end of the elongated member; and at least a second elongated member shorter than the first elongated member having a second proximal end connected to the first proximal end of the first elongated member and adjacent to the control module housing.

12. The vibratory device of claim 11, wherein the distal end of the first elongated member is covered in an over-mold having a convex surface facing towards the docking portion and a concave surface facing away from the docking portion, wherein the over-mold extends beyond the spine and tapers down to a thinner flat portion along edges of the over-mold.

13. The vibratory device of claim 8, wherein the spine of the vibratory device comprises:

an elongated member with two arms extending from a branching point of a longer leg to form a 'Y' shape section, wherein the longer leg curves below the two arms; and an extension section having two ends, wherein a first end is connected to the docking portion and a second end is connected to the longer leg of the 'Y' shaped section, and the extension section extends away from the longer leg in a plane tangent to the longer leg.

14. The vibratory device of claim 13, wherein a distal end of the longer leg is covered in an over-mold having a convex surface facing towards the docking portion and a concave surface facing away from the docking portion, wherein the over-mold extends beyond the spine and tapers down to a thinner flat portion along edges of the over-mold.

15. A vibrator comprising:

a control module;

a plurality of elongated members extending from the control module;

a pliable over-mold covering at least a portion of the elongated members and control module; and a plurality of vibratory mechanisms, each of the plurality of vibratory mechanisms affixed to a distal end of each of the elongated members in a one-to-one relationship with one of the plurality of vibratory mechanisms connected to one of the elongated members, the vibratory mechanisms in electrical communication with the controller.

16. The vibrator of claim 15, wherein the control module is irremovable from the elongated members.

17. The vibrator of claim 15 wherein one of the elongate members comprising two elongated clitoral members extending away from the control module and forming an angle θ between the clitoral members and the other one of the elongated members.

18. The vibrator of claim 15, wherein the elongated members have channels formed therein, and the vibratory mechanisms affixed to the distal ends of the elongated members are electrically connected to the control module by wires that run along the channels.

19. The vibrator of claim 18, which further comprises a junction box in a flared portion of a proximal end of one of the elongated members, wherein the wires from the vibratory mechanisms are connected to the wires from the control module at the junction box.

20. The vibrator of claim 18, wherein the control module communicates power and control signals separately to each one of the plurality of vibratory mechanisms, the power and control signals communicated along the wires.

* * * * *